US008365411B2

(12) United States Patent
Saito et al.

(10) Patent No.: US 8,365,411 B2
(45) Date of Patent: Feb. 5, 2013

(54) METHOD OF PRODUCING METAL CLOSED-SECTION MEMBER

(75) Inventors: Naoko Saito, Hiroshima (JP); Kyosou Ishida, Hiroshima (JP); Tetsuo Hamamoto, Hiroshima (JP)

(73) Assignee: Mazda Motor Corporation (JP)

( * ) Notice: Subject to any disclaimer, the term of this patent is extended or adjusted under 35 U.S.C. 154(b) by 715 days.

(21) Appl. No.: 12/548,044

(22) Filed: Aug. 26, 2009

(65) Prior Publication Data

US 2010/0218375 A1 Sep. 2, 2010

(30) Foreign Application Priority Data

Sep. 1, 2008 (JP) ..... 2008-223152
Sep. 1, 2008 (JP) ..... 2008-223155
Sep. 30, 2008 (JP) ..... 2008-253630

(51) Int. Cl.
*B21D 53/88* (2006.01)

(52) U.S. Cl. ..... 29/897.2; 296/187.01; 72/368

(58) Field of Classification Search ..... 29/897.2; 296/187.01, 187.02; 72/368
See application file for complete search history.

(56) References Cited

U.S. PATENT DOCUMENTS 1,330,782 A * 2/1920 Brown ..... 72/368
1,344,105 A * 6/1920 Vance ..... 72/368
1,879,077 A * 9/1932 Carlsen ..... 72/368
1,879,078 A * 9/1932 Carlsen ..... 72/368
2,115,441 A * 4/1938 Black ..... 72/368
2,889,866 A * 6/1959 Braun ..... 72/331
3,638,465 A * 2/1972 Lickliter et al. ..... 72/181

(Continued)

FOREIGN PATENT DOCUMENTS

EP 1 088 606 A2 4/2001
JP 49-23251 Y 6/1974

(Continued)

OTHER PUBLICATIONS

Japanese Office Action "Notice of Reasons for Rejection" issued Jul. 13, 2010; Japanese Application No. 2008-253630.

(Continued)

*Primary Examiner* — David Bryant
*Assistant Examiner* — Jacob Cigna
(74) *Attorney, Agent, or Firm* — Studebaker & Brackett PC; Donald R. Studebaker

(57) ABSTRACT

The present invention provides a method capable of accurately producing a metal closed-section member in a relatively simple manner. The method of producing a metal closed-section member formed in a cross-sectionally closed shape, from a metal plate workpiece, comprises a first press-forming step of using a first forming die assembly to press-form the plate workpiece into a convex shape, and a second press-forming step of providing a second forming die assembly, and, after the first press-forming step, under a condition that the press-formed plate workpiece is positioned between a receiving die and a core die of the second forming die assembly, causing relative movement of the core die with respect to the receiving die to press-form the press-formed plate workpiece into a given shape so that two sidewalls of a convex-shaped portion of the press-formed plate workpiece formed on respective ones of both sides of a top wall of the convex-shaped portion of the press-formed plate workpiece during the first press-forming step are displaced toward an inward side of the press-formed plate workpiece and cross-sectionally closed together.

6 Claims, 24 Drawing Sheets

U.S. PATENT DOCUMENTS

| | | | | |
|---|---|---|---|---|
| 4,395,900 | A * | 8/1983 | Saurenman | 72/368 |
| 5,058,269 | A * | 10/1991 | May | 29/897.35 |
| 6,601,427 | B2 * | 8/2003 | Kondou et al. | 72/368 |
| 6,976,531 | B2 * | 12/2005 | Martin et al. | 165/167 |
| 6,983,770 | B2 * | 1/2006 | Kondou et al. | 138/177 |
| 7,325,435 | B2 * | 2/2008 | Hamel et al. | 72/370.04 |

FOREIGN PATENT DOCUMENTS

| | | | |
|---|---|---|---|
| JP | 63-278614 | A | 11/1988 |
| JP | H07-299520 | A | 11/1995 |
| JP | 8-90095 | A | 4/1996 |
| JP | 9-276934 | A | 10/1997 |
| JP | 10-58040 | A | 3/1998 |
| JP | 2000-051932 | A | 2/2000 |
| JP | 2000-79415 | A | 3/2000 |
| JP | 2006-159281 | A | 6/2006 |
| WO | 02/064277 | A1 | 8/2002 |
| WO | 2006/056046 | A2 | 6/2006 |

OTHER PUBLICATIONS

Extended European Search Report dated Feb. 5, 2010; Application No. 09167697.3-2302.

Japanese Office Action "Notice of the Reasons for Rejection" issued on Feb. 14, 2012; Japanese Patent Application No. 2010-201602.

* cited by examiner

METHOD OF PRODUCING METAL CLOSED-SECTION MEMBER

BACKGROUND OF THE INVENTION

1. Field of the Invention

The present invention relates to a method of producing a metal closed-section member formed in a cross-sectionally closed shape, from a metal plate workpiece.

2. Description of the Related Art

As is commonly known, in view of ensuring strength and rigidity of a vehicle body to provide enhanced safety in a vehicle, such as an automobile, it is necessary for a vehicle body member making up a part of a basic structure of the vehicle body, such as a pillar member, a front or rear side frame, or a dash cross-member located in a lower region of a front surface of a dash panel, to achieve higher strength and rigidity, as well as weight reduction for improvement in fuel economy.

With a view to meeting the above needs, the vehicle body member is comprised of a metal closed-section member, in many cases. As one example of means for producing such a metal closed-section member, there has been commonly known a method which comprises subjecting each of a pair of metal plate workpieces, such as steel plates, to press working to form a pair of cross-sectionally hat-shaped (or cross-sectionally angular C-shaped) plate workpieces each integrally having a flange portion extending outwardly from a respective one of two free edges thereof, butting respective flange portions of the pair of cross-sectionally hat-shaped plate workpieces in such a manner as to define a closed-section space therebetween, and then welding the flange portions together to produce a metal closed-section member.

There has also been known a method of producing a triangular-shaped tube as a metal closed-section member, wherein the method comprises a first bending step of bending opposite ends of a steel plate pre-cut into a given shape, to have a given curvature, a second bending step of pressing and bending a central portion of the steel plate bent in the first bending step, a restraint-forming step of pressing the opposite ends of the steel plate bent in the second bending step, downwardly from thereabove, while applying restraint forces to the central portion of the steel plate from respective opposed rightward and leftward directions perpendicular to a longitudinal direction of the steel plate, so that the steel plate is formed under restraint into a given shape where the opposite ends are butted together, and a welding step of, after the restraint-forming step, welding the butted portions of the opposite ends without releasing the restraint forces, as disclosed, for example, in the Japanese Patent Laid-Open Publication No. 2000-51932.

Late years, in vehicles, such as automobiles, there has been an increasing need for further weight reduction to improve fuel economy, and vehicle body members occupying a relatively large part of vehicle weight have also been required to accelerate further weight reduction. Therefore, in regard to a vehicle body member to be formed as a metal closed-section member, it is desired to produce the metal closed-section member without providing a flange portion thereto.

The method disclosed in the Japanese Patent Laid-Open Publication No. 2000-51932 can produce a triangular closed-section shaped tube without providing a flange portion thereto. However, a vehicle body member for use in a vehicle, such as an automobile, generally has a complicated shape, wherein a cross-sectional shape is highly likely to change complicatedly in a longitudinal direction of the member. Thus, in case where the production method disclosed in the Japanese Patent Laid-Open Publication No. 2000-51932 is applied to a vehicle body member, it is necessary to prepare as a forming die a plurality of plates each formed with a cutout having the same shape as that of a cross section of a metal closed-section member to be formed. Moreover, during the step of pressing opposite ends of the bent steel plate downwardly from thereabove while applying restraint forces to a central portion of the steel plate in respective opposed rightward and leftward directions perpendicular to a longitudinal direction of the steel plate, so that the steel plate is formed under restraint into a given shape by the plurality of plates each formed with the cutout having the same shape as that of a cross section of a closed-section member to be formed, a forming defect, such as distortion or deformation, is liable to occur, which is likely to cause considerable difficulty in producing the metal closed-section member with a high degree of accuracy.

SUMMARY OF THE INVENTION

In view of the above technical problems, it is an object of the present invention to provide a method capable of accurately producing a metal closed-section member in a relatively simple manner.

In order to achieve the above object, in a first aspect of the present invention, there is provided a method of producing a metal closed-section member formed in a cross-sectionally closed shape, from a metal plate workpiece. The method comprises: a first press-forming step of providing a first forming die assembly, and, under a condition that the plate workpiece is clamped between a die and a blank holder of the first forming die assembly, causing relative movement of a punch of the first forming die assembly with respect to the die to allow the punch to be moved into a forming space of the die, so that the plate workpiece is press-formed into a shape convexly protruding in a direction of the movement of the punch relative to the die; and a second press-forming step of providing a second forming die assembly, and, after the first press-forming step, under a condition that the press-formed plate workpiece is positioned between a receiving die and a core die of the second forming die assembly, wherein the core die is disposed on the side opposite to the convexly protruding direction of the press-formed plate workpiece, causing relative movement of the core die with respect to the receiving die to allow a top wall of a convex-shaped portion of the press-formed plate workpiece to be pressed in the convexly protruding direction of the press-formed plate workpiece and formed into a given shape, so that two sidewalls of the convex-shaped portion of the press-formed plate workpiece formed on respective ones of both sides of the top wall during the first press-forming step are displaced toward an inward side of the press-formed plate workpiece and cross-sectionally closed together.

In a second aspect of the present invention, the method according to the first aspect of the present invention further comprises an end-bending step of, between the first press-forming step and the second press-forming step, bending at least one of respective ends of the sidewalls of the press-formed plate workpiece on the side opposite to the top wall, toward the inward side of the press-formed plate workpiece.

In a third aspect of the present invention, in the method according to the first aspect of the present invention, the first press-forming step includes causing relative movement between the punch and the die of the first forming die assembly to allow the punch to be moved into the forming space of the die, so that the plate workpiece is press-formed into the shape convexly protruding in the direction of the movement of the punch relative to the die, and a convex wall portion is formed in the top wall of the press-formed plate workpiece to protrude in a direction opposite to the convexly protruding direction of the press-formed plate workpiece, and the second press-forming step includes, under a condition that the press-formed plate workpiece is held on the receiving die of the second forming die assembly while allowing the convex wall portion of the press-formed plate workpiece to be placed on a concave portion or a flat portion of the receiving die, pressing the convex wall portion of the press-formed plate workpiece in the convexly protruding direction of the press-formed plate workpiece to allow the convex wall portion of the press-formed plate workpiece to be flattened and formed as a press-formed wall, by an interaction between a core die of the second forming die assembly and the concave portion or the flat portion, so that the sidewalls of the press-formed plate workpiece formed on the respective ones of both sides of the top wall during the first press-forming step are displaced toward the inward side of the press-formed plate workpiece and cross-sectionally closed together.

In a fourth aspect of the present invention, in the method according to the third aspect of the present invention, the convex wall portion of the top wall of the press-formed plate workpiece is formed in a cross-sectionally arc or trapezoidal shape.

In a fifth aspect of the present invention, the method according to the first aspect of the present invention further comprises a final press-forming step of, after the second press-forming step, pressing respective ends of the cross-sectionally-closed sidewalls of the press-formed plate workpiece against a surface of the core die on an opposite side of a surface thereof used to press the top wall.

In a sixth aspect of the present invention, the method according to the first aspect of the present invention further comprises a welding step of, after the second press-forming step, mutually welding the respective ends of the cross-sectionally-closed sidewalls of the press-formed plate workpiece.

In a seventh aspect of the present invention, in the method according to the first aspect of the present invention, the core die of the second forming die assembly for use in the second press-forming step has a cross-sectional width less than that of the closed-section member.

In a eighth aspect of the present invention, in the method according to the third aspect of the present invention, when the closed-section member has two sidewalls located on respective ones of both sides of the press-formed wall, wherein a cross-sectional length of at least one of the sidewalls changes in a longitudinal direction of the closed-section member, the first press-forming step includes forming the convex wall portion to divide the top wall into two top wall portions along a longitudinal direction of the press-formed plate workpiece, in such a manner that a cross-sectional length of at least one of the top wall portions of the top wall divided by the convex wall portion changes in the longitudinal direction, and the receiving die of the second forming die assembly for use in the second press-forming step is configured such that a cross-sectional length of a side surface of the concave portion of the receiving die is approximately equal to a shortest one of a plurality of cross-sectional lengths of the at least one top wall portion of the top wall.

In a ninth aspect of the present invention, in the method according to the first aspect of the present invention, the first press-forming step is a preliminary bend-forming step of preliminarily bend-forming the plate workpiece into a given shape, and the second press-forming step includes an intrusion-forming sub-step of pressing the plate workpiece bend-formed in the preliminary bend-forming step, into the concave portion of the receiving die of the second forming die assembly by the core die of the second forming die assembly, to intrusion-form the bend-formed plate workpiece into a shape where at least one of opposite ends thereof extends in a direction opposite to a pressing direction of the core die and toward an inward side of the concave portion, and a final bend-forming sub-step of, under a condition that the core die is held within the plate workpiece intrusion-formed in the intrusion-forming sub-step, pressing and bending the ends of the intrusion-formed plate workpiece by a punch of the second forming die assembly to bring the ends of the intrusion-formed plate workpiece into contact with each other by the punch and the core die, so that the intrusion-formed plate workpiece is formed into the cross-sectionally closed shape, wherein the preliminary bend-forming step includes bend-forming the plate workpiece into a shape which allows the at least one end of the bend-formed plate workpiece to extend in the direction opposite to the pressing direction of the core die and toward the inward side of the concave portion of the receiving die of the second forming die assembly, when the bend-formed plate workpiece is pressed into the concave portion of the receiving die.

In a tenth aspect of the present invention, in the method according to the ninth aspect of the present invention, the intrusion-forming sub-step includes moving the core die of the second forming die assembly into the concave portion of the receiving die of the second forming die assembly by driving means which is additionally used to move the punch of the second forming die assembly during the final bend-forming sub-step.

In a eleventh aspect of the present invention, in the method according to the tenth aspect of the present invention, the intrusion-forming sub-step includes moving the core die of the second forming die assembly into the concave portion while interposing a liner member between the core die and the punch of the second forming die assembly, and the final bend-forming sub-step includes, under a condition that the liner member is detached from between the core die and the punch of the second forming die assembly, and the core die is held within the plate workpiece intrusion-formed in the intrusion-forming sub-step, bending the ends of the intrusion-formed plate workpiece by the punch of the second forming die assembly.

In a twelfth aspect of the present invention, the method according to the ninth aspect of the present invention further comprises a welding step of, after the final bend-forming step, mutually welding the respective ends of the finally-bend-formed plate workpiece which are in contact with each other.

The metal closed-section member production method according to the first aspect of the present invention comprises a first press-forming step of, under a condition that a metal plate workpiece is clamped between a die and a blank holder of a first forming die assembly, causing relative movement of a punch of the first forming die assembly with respect to the die to allow the punch to be moved into a forming space of the die, so that the plate workpiece is press-formed into a convexly protruding shape, and a second press-forming step of, under a condition that the press-formed plate workpiece is positioned between a receiving die and a core die of a second forming die assembly, causing relative movement of the core die with respect to the receiving die to allow a top wall of a convex-shaped portion of the press-formed plate workpiece to be press-formed into a given shape, so that two sidewalls of the convex-shaped portion on respective ones of both sides of the top wall are displaced toward the inward side of the press-formed plate workpiece and cross-sectionally closed together. This makes it possible to accurately produce a metal closed-section member in a relatively simple manner while preventing the occurrence of crimples in the plate workpiece.

The metal closed-section member production method according to the second aspect of the present invention further comprises an end-bending step of, between the first press-forming step and the second press-forming step, bending at least one of respective ends of the sidewalls of the press-formed plate workpiece on the side opposite to the top wall, toward the inward side of the press-formed plate workpiece. This makes it possible to reduce a displacement of the press-formed plate workpiece toward the inward side of the sidewalls when the press-formed plate workpiece is formed into a cross-sectionally closed shape, to further accurately produce a metal closed-section member.

In the metal closed-section member production method according to the third aspect of the present invention, the first press-forming step includes forming, in the top wall of the press-formed plate workpiece, a convex wall portion protruding in a direction opposite to the convexly protruding direction of the press-formed plate workpiece, and the second press-forming step includes pressing the convex wall portion of the press-formed plate workpiece to allow the convex wall portion of the press-formed plate workpiece to be flattened and formed as a press-formed wall, so that the sidewalls of the press-formed plate workpiece on the respective ones of both sides of the top wall are displaced toward the inward side of the press-formed plate workpiece and cross-sectionally closed together. This makes it possible to obtain the above advantages in a relatively simple manner without causing structural complexity in a forming apparatus, such as a forming die assembly.

In the metal closed-section member production method according to the fourth aspect of the present invention, the convex wall portion of the top wall of the press-formed plate workpiece is formed in a cross-sectionally arc or trapezoidal shape. This makes it possible to prevent the occurrence of crack or the like in the convex wall portion to effectively obtain the above advantages.

The metal closed-section member production method according to the fifth aspect of the present invention further comprises a final press-forming step of pressing the ends of the cross-sectionally-closed sidewalls of the press-formed plate workpiece against a surface of the core die on an opposite side of a surface thereof to be used to press the top wall. This makes it possible to achieve a high degree of forming accuracy even in a surface of the press-formed plate workpiece on the side opposite to the press-formed surface, in a relatively simple manner.

The metal closed-section member production method according to the sixth aspect of the present invention further comprises a welding step of, after the second press-forming step, mutually welding the respective ends of the cross-sectionally-closed sidewalls of the press-formed plate workpiece. This makes it possible to increase joint strength of a metal closed-section member to produce a stronger metal closed-section member.

In the metal closed-section member production method according to the seventh aspect of the present invention, the core die for use in the second press-forming step has a cross-sectional width less than that of the closed-section member. In case where a convex wall portion protruding toward an inward side of a closed-section space of a metal closed-section member is also formed in at least one of the sidewalls, this feature makes it possible to prevent interference between the core die and the convex wall portion formed in the at least one sidewall during the second press-forming step for cross-sectionally closing the sidewalls together.

In the metal closed-section member production method according to the eighth aspect of the present invention, the first press-forming step includes forming the convex wall portion in such a manner that a cross-sectional length of at least one of two top wall portion of the top wall divided by the convex wall portion changes in the longitudinal direction, and the receiving die of the second forming die assembly for use in the second press-forming step is configured such that a cross-sectional length of a side surface of the concave portion of the receiving die is approximately equal to a shortest one of a plurality of cross-sectional lengths of the at least one top wall portion of the top wall. Thus, even in a process of producing a metal closed-section member where a cross-sectional length of at least one of two sidewalls formed on respective ones of both sides of the press-formed wall changes in a longitudinal direction of the metal closed-section member, the sidewalls can be press-formed on the respective ones of both sides of the press-formed wall at approximately the same timing. This makes it possible to stably perform the press-forming.

In the metal closed-section member production method according to the ninth aspect of the present invention, the first press-forming step is a preliminary bend-forming step of preliminarily bend-forming the plate workpiece into a given shape, and the second press-forming step includes an intrusion-forming sub-step of pressing the bend-formed plate workpiece into the concave portion of the receiving die of the second forming die assembly by the core die of the second forming die assembly, to intrusion-form the bend-formed plate workpiece into a shape where at least one of opposite ends thereof extends in a direction opposite to a pressing direction of the core die and toward an inward side of the concave portion, and a final bend-forming sub-step of, under a condition that the core die is held within the intrusion-formed plate workpiece, pressing and bending the ends of the intrusion-formed plate workpiece by the punch of the second forming die assembly to bring the ends of the intrusion-formed plate workpiece into contact with each other by the punch and the core die, so that the intrusion-formed plate workpiece is formed into the cross-sectionally closed shape. This makes it possible to obtain the above advantages in a relatively simple manner without causing structural complexity in a forming apparatus, such as a forming die assembly.

In the metal closed-section member production method according to the tenth aspect of the present invention, the intrusion-forming sub-step includes moving the core die of the second forming die assembly into the concave portion of the receiving die of the second forming die assembly by driving means which is additionally used to move the punch of the second forming die assembly during the final bend-forming sub-step. This makes it possible to carry out the intrusion-forming in a relatively simple manner without a need for transferring the intrusion-formed plate workpiece between the intrusion-forming sub-step and the final bend-forming sub-step.

In the metal closed-section member production method according to the eleventh aspect of the present invention, the intrusion-forming sub-step includes moving the core die of the second forming die assembly into the concave portion while interposing a liner member between the core die and the punch, and the final bend-forming sub-step includes, under a condition that the liner member is detached from between the core die and the punch, and the core die is held within the intrusion-formed plate workpiece, bending the ends of the intrusion-formed plate workpiece by the punch. This makes it possible to obtain the above advantages while preventing interference between the bend-formed plate workpiece and the punch during the intrusion-forming sub-step based on the liner member.

The metal closed-section member production method according to the twelfth aspect of the present invention, further comprises a welding step of, after the final bend-forming step, mutually welding the respective ends of the press-formed plate workpiece which are in contact with each other. This makes it possible to increase joint strength of a metal closed-section member to produce a stronger metal closed-section member

DESCRIPTION OF THE PREFERRED EMBODIMENTS

With reference to the accompanying drawings, the present invention will now be described based on an embodiment thereof. Although the following description will be made using some terms indicative of specific directions and specific positions (e.g., "upward", "upper", "downward", "lower", "rightward", "right", "leftward", "left" and similar terms thereto or relevant terms including the term), such terms are intended to facilitate understanding of the invention in combination with reference to the drawings, but not to limit the technical scope of the present invention to respective specific meanings of the terms.

Figure 1:
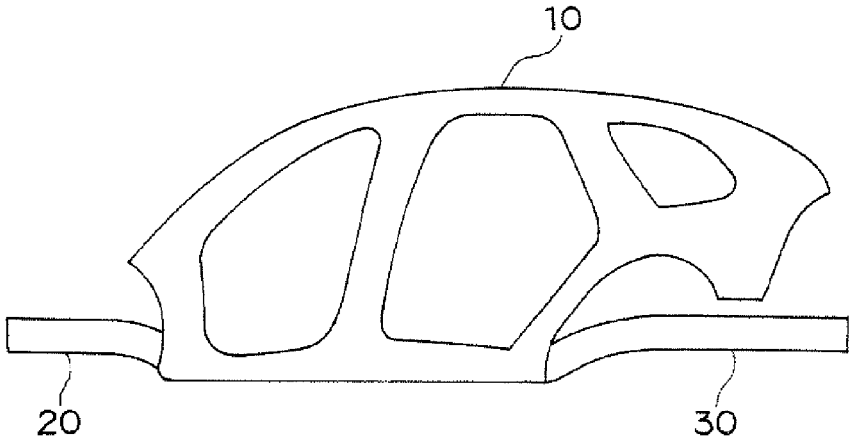
FIG. 1 is a side view schematically showing a structure of an automobile body having a metal closed-section member produced by a method according to a first embodiment of the present invention.

FIG. 1 is a side view schematically showing a structure of an automobile body having a metal closed-section member produced by a method according to a first embodiment of the present invention. The metal closed-section member production method according to the first embodiment is used for forming a metal plate workpiece into a cross-sectionally closed shape to produce a front side frame 20 to be connected to a side body 10 of the automobile, as shown in FIG. 1. Alternatively, the present invention may be applied to production of any other suitable automobile body member, such as a rear side frame 30 to be connected to the side body 10. Further, the present invention may be applied to production of any metal closed-section member other than the automobile body member.

Figure 2:
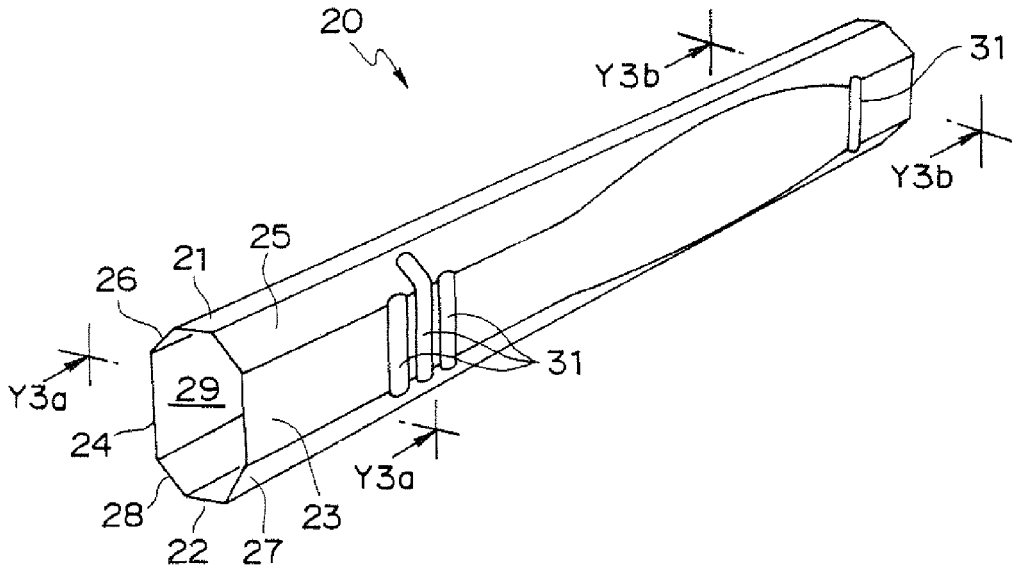
FIG. 2 is a perspective view showing a front side frame as a metal closed-section member produced by the method according to the first embodiment.
Figure 3A:
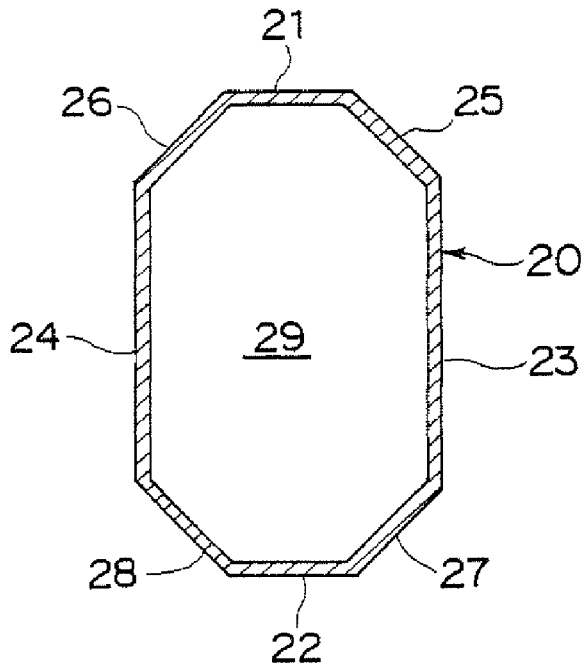
FIG. 3A is a sectional view of the front side frame, taken along the line Y3*a*-Y3*a* in FIG. 2.
Figure 3B:
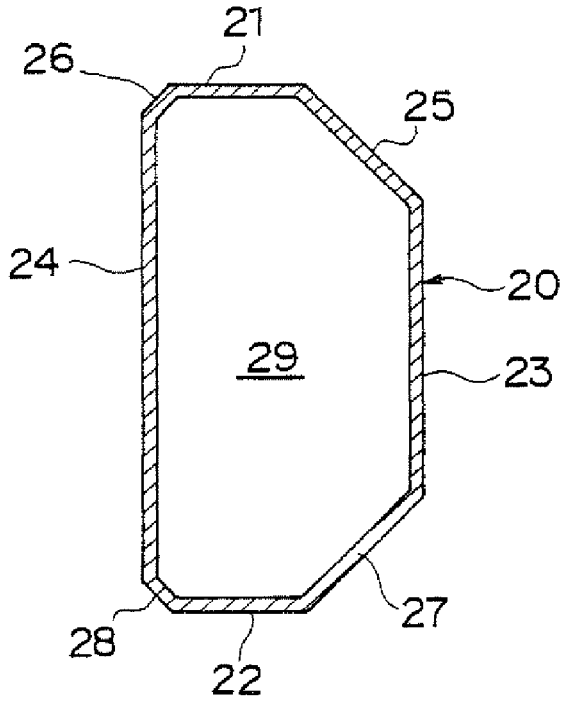
FIG. 3B is a sectional view of the front side frame, taken along the line Y3*b*-Y3*b* in FIG. 2.

FIG. 2 is a perspective view showing a front side frame as a metal closed-section member produced by the method according to the first embodiment. FIG. 3A is a sectional view of the front side frame, taken along the line Y3*a*-Y3*a* in FIG. 2, and FIG. 3B is a sectional view of front side frame, taken along the line Y3*b*-Y3*b* in FIG. 2.

As shown in FIG. 2, the front side frame 20 as a metal closed-section member produced by the method according to the first embodiment is formed as a metal member having a longitudinally long and cross-sectionally closed shape. More specifically, the front side frame 20 is formed in a cross-sectionally octagonal shape to have a hollow space 29 defined by a top wall 21, a bottom wall 22, a right sidewall 23, a left sidewall 24, a first inclined sidewall 25 inclinedly extending from the top wall 21 obliquely downwardly and rightwardly to the right sidewall 23, a second inclined sidewall 26 inclinedly extending from the top wall 21 obliquely downwardly and leftwardly to the left sidewall 24, a third inclined sidewall 27 inclinedly extending from the bottom wall 22 obliquely upwardly and rightwardly to the right sidewall 23, and a fourth inclined sidewall 28 inclinedly extending from the bottom wall 22 obliquely upwardly and leftwardly to the right sidewall 23.

The front side frame 20 is formed such that the top wall 21 and the bottom wall 22 extend in parallel along a longitudinal direction of the front side frame 20 and have approximately the same cross-sectional length, whereas a cross-sectional shape changes in the longitudinal direction, as shown in FIG. 2. Specifically, the front side frame 20 is formed such that each of the first inclined sidewall 25 and the third inclined sidewall 27 in the cross-section illustrated in FIG. 3A has a cross-sectional length less than that of a corresponding one of the first inclined sidewall 25 and the third inclined sidewall 27 in the cross-section illustrated in FIG. 3B, and the right sidewall 23 in the cross-section illustrated in FIG. 3A has a cross-sectional length greater than that of the right sidewall 23 in the cross-section illustrated in FIG. 3B. Further, the front side frame 20 is formed such that each of the second inclined sidewall 26 and the fourth inclined sidewall 28 in the cross-section illustrated in FIG. 3A has a cross-sectional length greater than that of a corresponding one of the second inclined sidewall 26 and the fourth inclined sidewall 28 in the cross-section illustrated in FIG. 3B, and the left sidewall 24 in the cross-section illustrated in FIG. 3A has a cross-sectional length less than that of the left sidewall 24 in the cross-section illustrated in FIG. 3B.

Each of the third inclined side wall 27 and the fourth inclined side wall 28 is formed such that an inclination angle thereof relative to the bottom wall 22 has a given constant value in the longitudinal direction. Further, in the front side frame 20, the right sidewall 23 and the first inclined sidewall 25 are formed with a plurality of beads 31 each concavely protruding toward an inside of the hollow space 29.

The method of producing the above front side frame 20 as a metal closed-section member, according to the first embodiment, will be described below.

In the first embodiment, in advance of producing the front side frame 20, a plate blank (plate workpiece) made of a metal material and formed in an approximately flat shape, such as a steel plate, is prepared. Then, the plate workpiece is formed into a convex shape by a press-forming process, specifically a draw-forming process, and further formed into a given shape in conformity to a desired shape of the front side frame 20.

Figure 4:
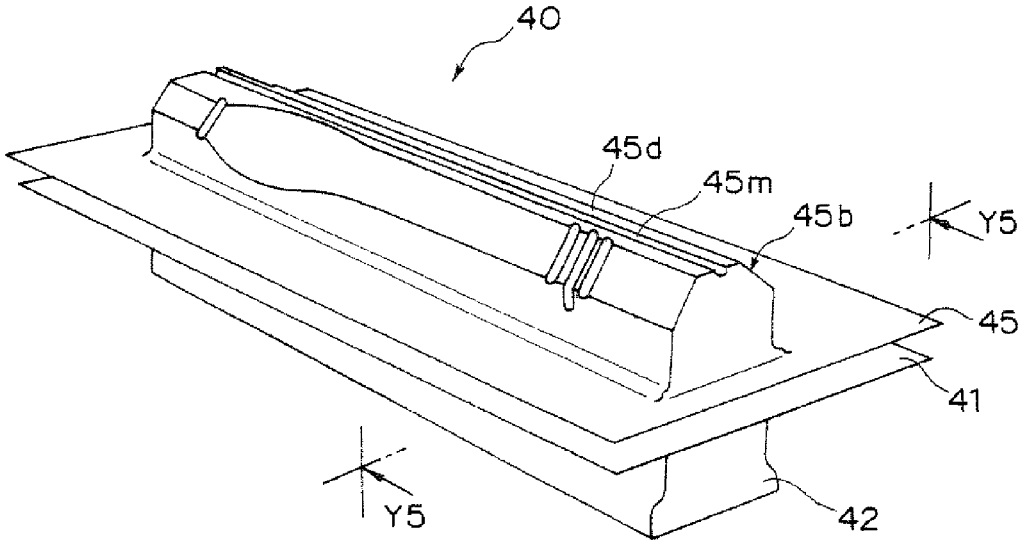
FIG. 4 is a perspective view showing a draw-forming die assembly of a draw-forming apparatus for draw-forming a metal plate workpiece into a given shape.
Figure 5:
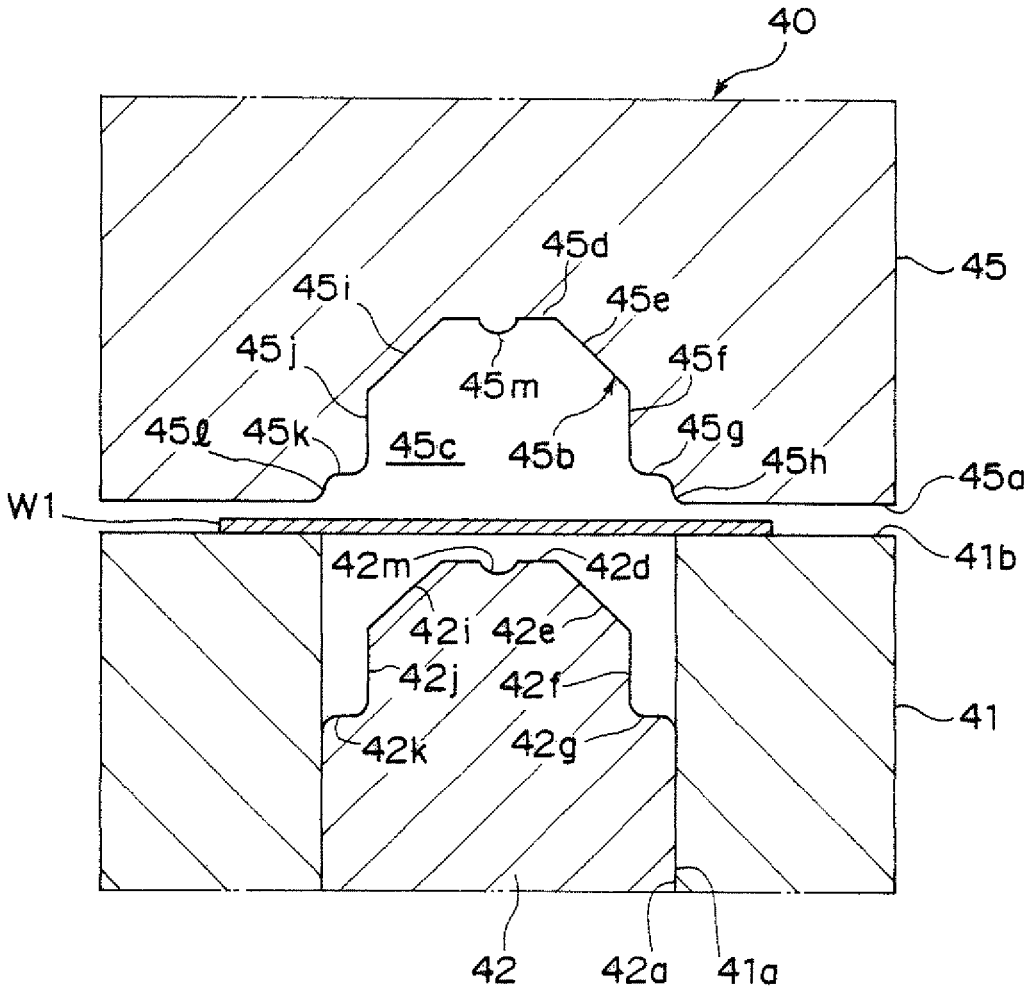
FIG. 5 is a sectional view of the draw-forming die assembly, taken along the line Y5-Y5 in FIG. 4.

FIG. 4 is a perspective view showing a draw-forming die assembly of a draw-forming apparatus for draw-forming a metal plate workpiece into a given shape. FIG. 5 is a sectional view of the draw-forming die assembly, taken along the line Y5-Y5 in FIG. 4. In FIG. 4, in regard to an after-mentioned die of the draw-forming die assembly, only a lower surface thereof is illustrated. Further, in regard to an after-mentioned blank holder of the draw-forming die assembly, only an upper surface thereof is illustrated.

As shown in FIGS. 4 and 5, the draw-forming die assembly (first forming die assembly) 40 of the draw-forming apparatus for draw-forming a metal plate workpiece into a given shape comprises a blank holder 41 for holding a metal plate workpiece W1, a punch 42 formed to have an outer peripheral surface 42*a* fitted in an inner peripheral surface 41*a* of the blank holder 41 and adapted to be movable relative to the blank holder 41 in an upward-downward direction, and a die 45 disposed in opposed relation to the blank holder 41 and the punch 42 and adapted to be movable in the upward-downward direction.

The die 45 of the draw-forming die assembly 40 has a concave portion 45*b* concavely formed in a lower surface 45*a* thereof, so that a forming space 45*c* is defined inside the concave portion 45*b* to draw-form the plate workpiece W1 into a given shape. The concave portion 45*b* provided in the die 45 of the draw-forming die assembly 40 is formed in a given shape in conformity to the desired shape of the front side frame 20. Specifically, as shown in FIG. 5, the concave portion 45*b* has a bottom surface 45*d* formed in an approximately flat or horizontal shape, a first inclined surface 45*e* inclinedly extending from the bottom surface 45*d* obliquely downwardly and rightwardly, a first right vertical surface 45*f* extending from the first inclined surface 45*e* vertically downwardly, a right horizontal surface 45*g* extending from the first right vertical surface 45*f* horizontally and rightwardly, a second right vertical surface 45*h* extending from the right horizontal surface 45*g* approximately vertically downwardly, a second inclined surface 45*i* inclinedly extending from the bottom surface 45*d* obliquely downwardly and leftwardly, a first left vertical surface 45*j* extending from the second inclined surface 45*i* vertically downwardly, a left horizontal surface 45*k* extending from the first left vertical surface 45*j* horizontally and leftwardly, and a second left vertical surface 45*l* extending from the left horizontal surface 45*k* approximately vertically downwardly. The bottom surface 45*d* of the concave portion 45*b* of the die 45 has a raised portion 45*m* formed in a cross-sectionally arc shape to protrude therefrom toward an inside of the forming space 45*c*. As shown in FIG. 4, the raised portion 45*m* is formed on the bottom surface 45*d* to extend in a longitudinal direction of the die 45.

The punch 42 of the draw-forming die assembly 40 is formed in a given shape in conformity to the desired shape of the front side frame 20 to form the plate workpiece W1 into a given shape in cooperation with the die 45 of the draw-forming die assembly 40. As shown in FIG. 5, a head of punch 42 has a top surface 42*d* formed in an approximately flat or horizontal shape, a first inclined surface 42*e* inclinedly extending from the top surface 42*d* obliquely downwardly and rightwardly, a right vertical surface 42*f* extending from the first inclined surface 42*e* vertically downwardly, a right horizontal surface 42*g* extending from the right vertical surface 42*f* horizontally and rightwardly, a second inclined surface 42*i* inclinedly extending from the top surface 42*d* obliquely downwardly and leftwardly, a left vertical surface 42*j* extending from the second inclined surface 42*i* vertically downwardly, a left horizontal surface 42*k* extending from the left vertical surface 42*j* horizontally and leftwardly. The top surface 42*d* of the punch 42 has a depressed portion 42*m* formed in a sectionally arc shape to lower therefrom. The depressed portion 42*m* is formed in the top surface 42*d* to extend in the longitudinal direction of the die 45.

The draw-forming apparatus equipped with the above draw-forming die assembly 40 is operable to move the punch 42 into the forming space 45*c* of the die 45 while clamping the plate workpiece W1 between the blank holder 41 and the die 45, to draw-form the plate workpiece W1 into a given shape in conformity to the desired shape of the front side frame 20. In the die 45 of the draw-forming die assembly 40, the second inclined surface 45*i* and the first left vertical surface 45*j* of the concave portion 45*b* have a plurality of bead-forming protrusions (not shown) each of which protrudes therefrom toward the inside of the forming space 45*c* in conformity to a shape of a respective one of the beads 31 of the front side frame 20. Correspondingly, in the punch 42 of the draw-forming die assembly 40, the second inclined surface 42*i* and the left vertical surface 42*j* have a plurality of bead-forming grooves (not shown) each concavely formed in conformity to the shape of the respective one of the beads 31.

In the draw-forming of the plate workpiece W1 using the draw-forming die assembly 40, under a condition that the blank holder 41 and the die 45 are positioned in spaced-apart relation to each other, and the top surface 42*d* of the punch 42 is positioned below an upper surface 41*b* of the blank holder 41, the plate workpiece W1 is held on the upper surface 41*b* of the blank holder 41, as shown in FIG. 5. Subsequently, the die 45 of the draw-forming die assembly 40 is moved downwardly to clamp opposite lateral (widthwise) ends of the plate workpiece W1 between the blank holder 41 and the die 45, and then the punch 42 is moved upwardly into the forming space 45*c* of the die 45 to draw-form the plate workpiece W1 into a given shape.

Figure 6A:
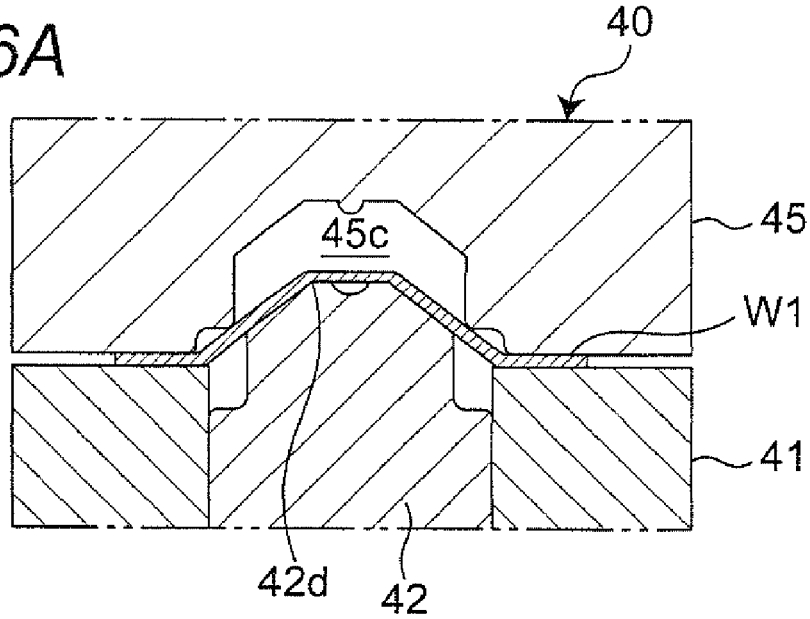
FIGS. 6A and 6B are explanatory diagrams showing a draw-forming process.
Figure 6B:
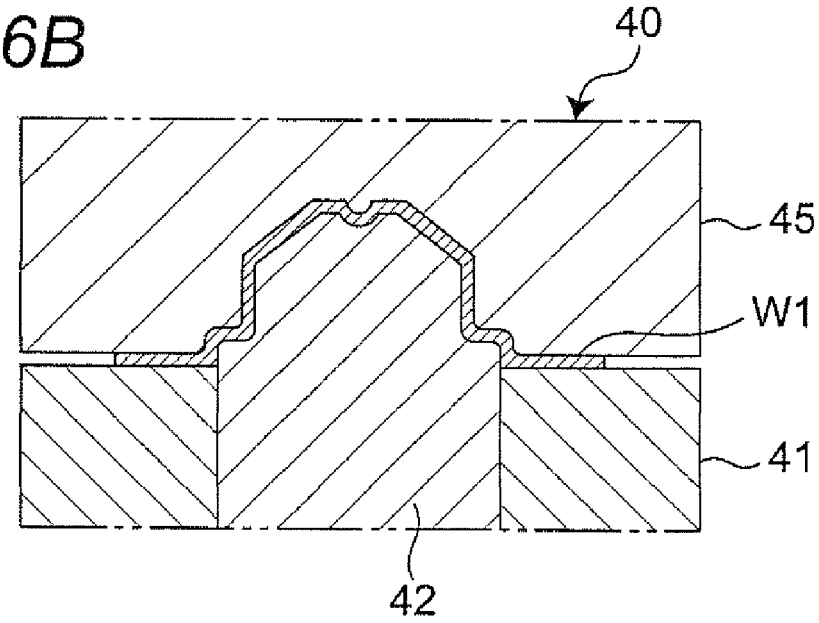

FIGS. 6A and 6B are explanatory diagrams showing a draw-forming process, wherein FIG. 6A illustrates a state when the punch is being moved upwardly after the plate workpiece is clamped between the blank holder and the die, to draw-form the plate workpiece into an intermediate shape, and FIG. 6B illustrates a state after the punch is fully moved upwardly to further draw-form the plate workpiece into a final shape.

As shown in FIG. 6A, when the punch 42 is being moved into the forming space 45*c* of the die 45 under a condition that the plate workpiece W1 is clamped between the blank holder 41 and the die 45, the plate workpiece W1 is draw-formed into a cross-sectionally trapezoidal shape by the top surface 42*d* of the punch 42. Then, as shown in FIG. 6B, when the punch 42 is fully moved upwardly, the plate workpiece W1 is further draw-formed into a given shape by an interaction between the punch 42 and the die 45.

Figure 7:
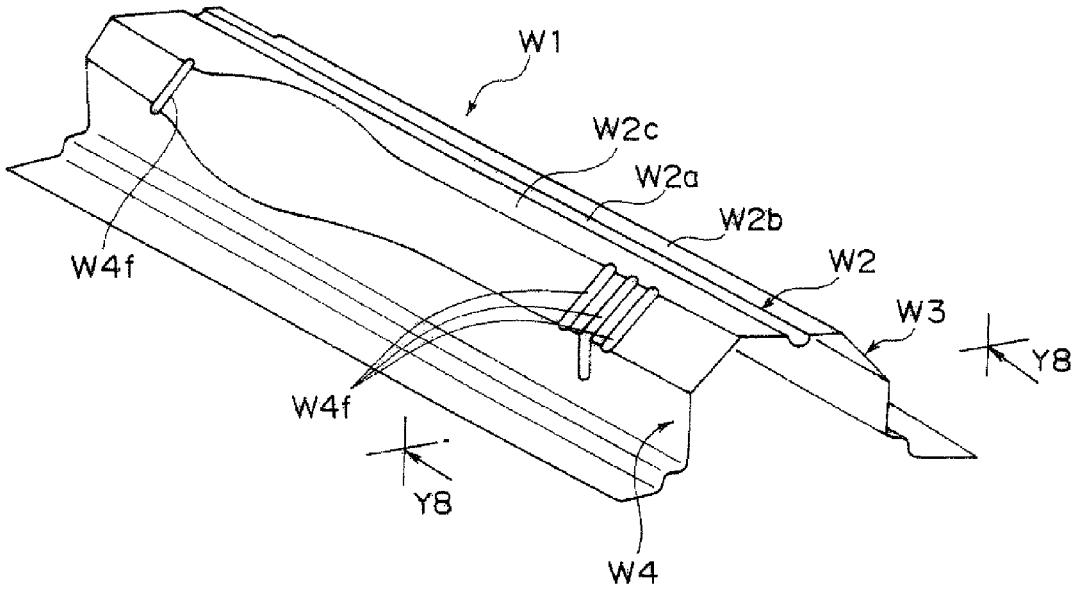
FIG. 7 is a perspective view showing a draw-formed plate workpiece
Figure 8:
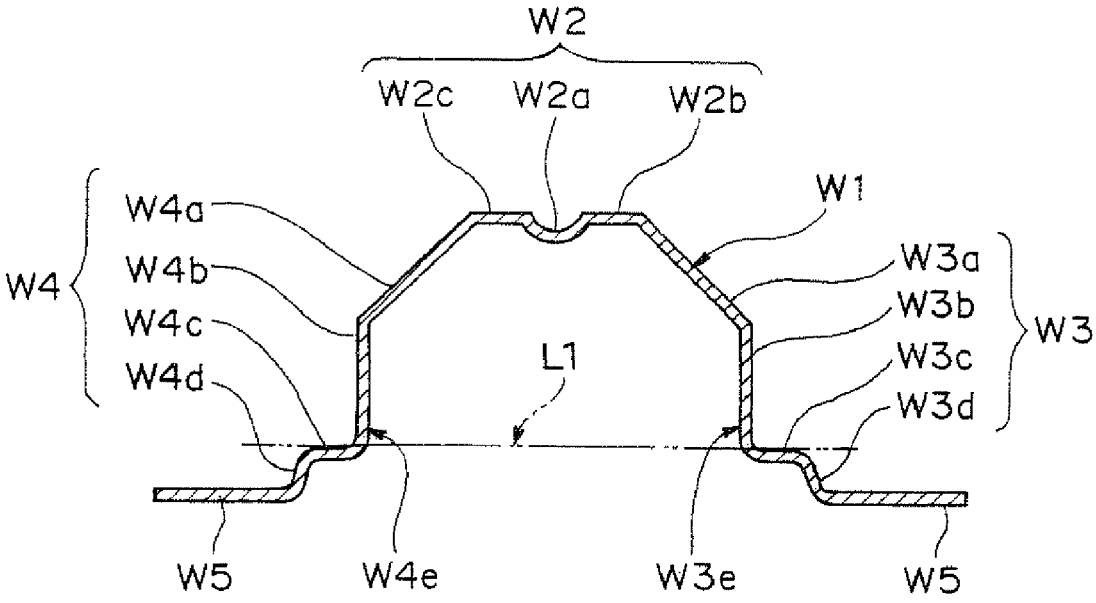
FIG. 8 is a sectional view of the draw-formed plate workpiece, taken along the line Y8-Y8 in FIG. 7.

FIG. 7 is a perspective view showing the draw-formed plate workpiece (i.e., the plate workpiece after the draw-forming), and FIG. 8 is a sectional view of the draw-formed plate workpiece, taken along the line Y8-Y8 in FIG. 7. As shown in FIGS. 7 and 8, a laterally central portion of the draw-formed plate workpiece W1, i.e., a portion of the draw-formed plate workpiece W1 other than the opposite lateral ends thereof which have been clamped between the blank holder 41 and the die 45, is press-formed in a shape convexly protruding in a direction of the movement of the punch 42 relative to the die 45, to have a top wall W2 of a convex-shaped portion (hereinafter arbitrarily referred to as a protruded top wall W2) of the press-formed plate workpiece, and two sidewalls W3, W4 of the convex-shaped portion (hereinafter arbitrarily referred to as protruded sidewalls W3, W4) of the press-formed plate workpiece on respective ones of both sides of the top wall W2.

In the draw-formed plate workpiece W1, the protruded top wall W2 is formed by an interaction between the bottom surface 45*d* of the concave portion 45*b* of the die 45, and the top surface 42*d* of the punch 42, wherein the protruded top wall W2 had a convex wall portion W2*a* formed to protrude in a cross-sectionally arc in a direction opposite to the convexly protruding direction of the draw-formed plate workpiece W1 and extend in a longitudinal direction of the draw-formed plate workpiece W1, by an interaction between the raised portion 45*m* of the bottom surface 45*d* and the depressed portion 42*m* of the top surface 42*d*. As shown in FIG. 7, the protruded top wall W2 is divided by the convex wall portion W2*a*, into a right top wall portion W2*b* located on a right side of the convex wall portion W2*a*, and a left top wall portion W2*c* located on a left side of the convex wall portion W2*a*, wherein each of the wall portions W2*b*, W2*c* divided by the convex wall portion W2*a* of the protruded top wall W2 is formed such that a cross-sectional length thereof in the lateral direction changes in the longitudinal direction.

The protruded sidewall W3 is formed on a right side of the protruded top wall W2 by an interaction between each of the first inclined surface 45*e*, the first right vertical surface 45*f*, the right horizontal surface 45*g* and the second right vertical surface 45*h* in the concave portion 45*b* of the die 45, and a corresponding one of the first inclined surface 42*e*, the right vertical surface 42*f*, the right horizontal surface 42*g* and the outer peripheral surface 42*a* in the punch 42. Specifically, the protruded sidewall W3 has a first right sidewall portion W3*a* formed by the interaction between the first inclined surface 45*e* of the concave portion 45*b* and the first inclined surface 42*e* of the punch 42, to inclinedly extend from the protruded top wall W2, specifically the right top wall portion W2*b*, obliquely downwardly and rightwardly, a second right sidewall portion W3*b* formed by the interaction between the first right vertical surface 45*f* of the concave portion 45*b* and the right vertical surface 42*f* of the punch 42, to extend from the first right sidewall portion W3*a* vertically downwardly, a third right sidewall portion W3*c* formed by the interaction between the right horizontal surface 45*g* of the concave portion 45*b* and the right horizontal surface 42*g* of the punch 42, to extend from the second right sidewall portion W3*b* horizontally and rightwardly, and a fourth right sidewall portion W3*d* formed by the interaction between the second right vertical surface 45*h* of the concave portion 45*b* and the outer peripheral surface 42*a* of the punch 42, to extend from the third right sidewall portion W3*c* vertically downwardly.

The protruded sidewall W4 is formed on a left side of the protruded top wall W2 by an interaction between each of the second inclined surface 45*i*, the first left vertical surface 45*j*, the left horizontal surface 45*k* and the second left vertical surface 45*l* in the concave portion 45*b* of the die 45, and a corresponding one of the second inclined surface 42*i*, the left vertical surface 42*j*, the left horizontal surface 42*k* and the outer peripheral surface 42*a* in the punch 42. Specifically, the protruded sidewall W4 has a first left sidewall portion W4*a* formed by the interaction between the second inclined surface 45*i* of the concave portion 45*b* and the second inclined surface 42*i* of the punch 42, to inclinedly extend from the protruded top wall W2, specifically the left top wall portion W2*c*, obliquely downwardly and leftwardly, a second left sidewall portion W4*b* formed by the interaction between the first left vertical surface 45*j* of the concave portion 45*b* and the left vertical surface 42*j* of the punch 42, to extend from the first left sidewall portion W4*a* vertically downwardly, a third left sidewall portion W4*c* formed by the interaction between the left horizontal surface 45*k* of the concave portion 45*b* and the left horizontal surface 42*k* of the punch 42, to extend from the second left sidewall portion W4*b* horizontally and rightwardly, and a fourth left sidewall portion W4*d* formed by the interaction between the second left vertical surface 45*l* of the concave portion 45*b* and the outer peripheral surface 42*a* of the punch 42, to extend from the third left sidewall portion W4*c* vertically downwardly.

Further, a plurality of beads W4*f* are formed in the protruded sidewall W4 of the draw-formed plate workpiece W1, specifically in the first and second left sidewall portions W4*a*, W4*b*, by an interaction between corresponding ones of the bead-forming protrusions formed on the second inclined surface 45*i* and the first left vertical surface 45*j*, and the bead-forming grooves formed in the second inclined surface 42*i* and the left vertical surface 42*j* of the punch 40.

Each of the convex wall portion W2*a*, the right top wall portion W2*b* and the left top wall portion W2*c* in the protruded top wall W2 is formed in conformity of a shape of a respective one of the bottom wall 22, the fourth inclined sidewall 28 and the third inclined sidewall 27 in the front side frame 20. Further, the first right sidewall portion W3*a* of the protruded sidewall W3 is formed in conformity of a shape of the left sidewall 24 of the front side frame 20, and the second right sidewall portion W3*b* of the protruded sidewall W3 is formed in conformity of a shape of the second inclined sidewall 26 and the top wall 21 of the front side frame 20. The first left sidewall portion W4*a* of the protruded sidewall W4 is formed in conformity of a shape of the right sidewall 23 of the front side frame 20, and the second left sidewall portion W4*b* of the protruded sidewall W4 is formed in conformity of a shape of the first inclined sidewall 25 and the top wall 21 of the front side frame 20.

As shown in FIG. 6, the draw-forming of the plate workpiece W1 is performed under a condition that the opposite lateral ends of the plate workpiece W1 are clamped between the blank holder 41 and the die 45. This prevents the occurrence of crimples in the draw-formed plate workpiece W1

After the draw-forming of the plate workpiece W1 using the draw-forming apparatus equipped with the draw-forming die assembly 40, a portion of the draw-formed plate workpiece W1 located below a blanking line L1 illustrated in FIG. 8 is blanked by blanking means (not shown), to cut away the lateral ends W5 of the draw-formed plate workpiece W1 which have been clamped between the blank holder 41 and the die 45, the third right sidewall portion W3*c*, the fourth right sidewall portion W3*d*, the third left sidewall portion W4*c*, and the fourth left sidewall portion W4*d*.

Figure 9:
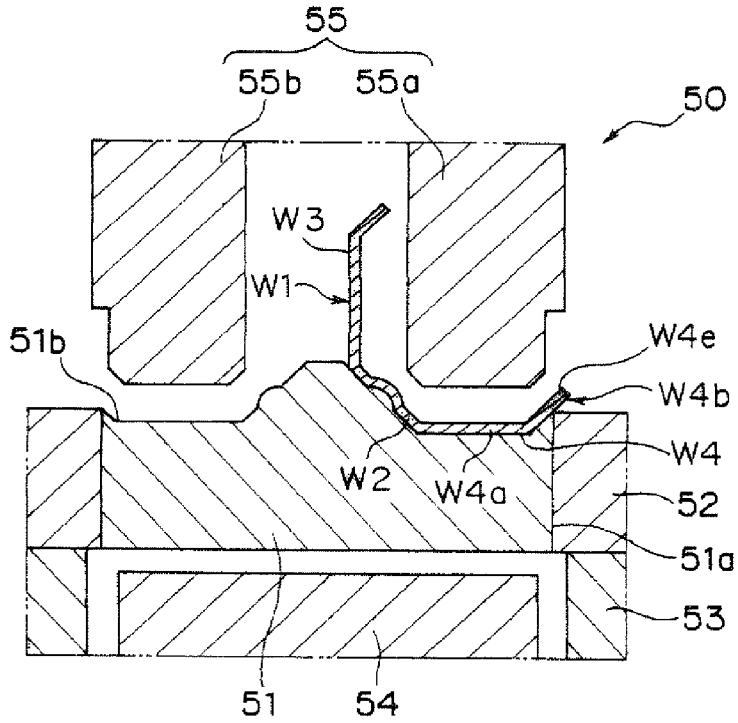
FIG. 9 is a sectional view of an end-bending die assembly of an end-bending apparatus for bending respective ends of two sidewalls of the draw-formed plate workpiece.

Subsequently, respective ends of the protruded sidewalls W3, W4 of the draw-formed plate workpiece W1 is bent inwardly, i.e., toward an inward side of the draw-formed plate workpiece W1. More Specifically, an end W3*e* (see FIG. 8) of the second right sidewall portion W3*b* of the protruded sidewall W3 on the side opposite to the protruded top wall W2, and an end W4*e* (see FIG. 8) of the second left sidewall portion W4*b* of the protruded sidewall W4 on the side opposite to the protruded top wall W2, are bent inwardly. FIG. 9 is a sectional view an end-bending die assembly of an end-bending apparatus for bending each of the ends of the protruded sidewalls of the draw-formed plate workpiece.

As shown in FIG. 9, the end-bending die assembly 50 of the end-bending apparatus for bending each of the ends W3*e*, W4*e* of the protruded sidewalls W3, W4 of the draw-formed plate workpiece W1 comprises a first die 51 for holding the draw-formed plate workpiece W1, a second die 52 fitted on an outer peripheral surface 51*a* of the first die 51, a third die 53 supporting the second die 52, a fourth die 54 disposed beneath the first die 51, and a punch 55 disposed in opposed relation to the first die 51 and adapted to be movable in an upward-downward direction.

The first die 51 of the end-bending die assembly 50 is biased upwardly by biasing means (not shown), in such a manner that it is located at its initial position spaced apart from the fourth die 54. As shown in FIG. 9, in order to bend-form the protruded sidewall W4 (specifically, the end W4*e* of the second left sidewall portion W4*b*) of the draw-formed plate workpiece W1 into a given shape, a right region of an upper surface 51*b* of the first die 51 is formed in conformity to the protruded top wall W2 and the protruded sidewall W4 of the draw-formed plate workpiece W1, to hold the draw-formed plate workpiece W1 while allowing the target end W4*e* of the second left sidewall portion W4*b* to be positioned on the second die 52. Further, in order to bend-form the protruded sidewall W3 (specifically, the end W3*e* of the second right sidewall portion W3*b*) of the draw-formed plate workpiece W1 into a given shape, a left region of the upper surface 51*b* of the first die 51 is formed in conformity to the protruded top wall W2 and the protruded sidewall W3 of the draw-formed plate workpiece W1, to hold the draw-formed plate workpiece W1 while allowing the target end W3*e* of the second right sidewall portion W3*b* to be positioned on the second die 52.

The punch 55 of the end-bending die assembly 50 comprises a right punch member 55*a* for pressing the draw-formed plate workpiece W1 held on the right region of the upper surface 51*b* of the first die 51, and a left punch member 55*b* for pressing the draw-formed plate workpiece W1 held on the left region of the upper surface 51*b* of the first die 51.

The end-bending apparatus equipped with the above end-bending die assembly 50 is operable to move the punch 55 downwardly while clamping the draw-formed plate workpiece between the first die 51 and the punch 55, to bend-form each of the ends W3*e*, W4*e* of the protruded sidewalls W3, W4 of the draw-formed plate workpiece W1 into a given shape by the second die 52.

In the end-bending of the ends W3*e*, W4*e* of the protruded sidewalls W3, W4 of the draw-formed plate workpiece W1 using the end-bending die assembly, the first die 51 is set at the initial position by the upward biasing force of the biasing means, and the draw-formed plate workpiece W1 is held on the right region of the upper surface 51*b* of the first die 51 in a posture where the first left sidewall portion W4*a* is located at the lowermost position, as shown in FIG. 9. Then, the punch 50 of the end-bending die assembly 50 is moved downwardly to perform the end-bending by an interaction between the punch 55 and the second die 52

Figure 10:
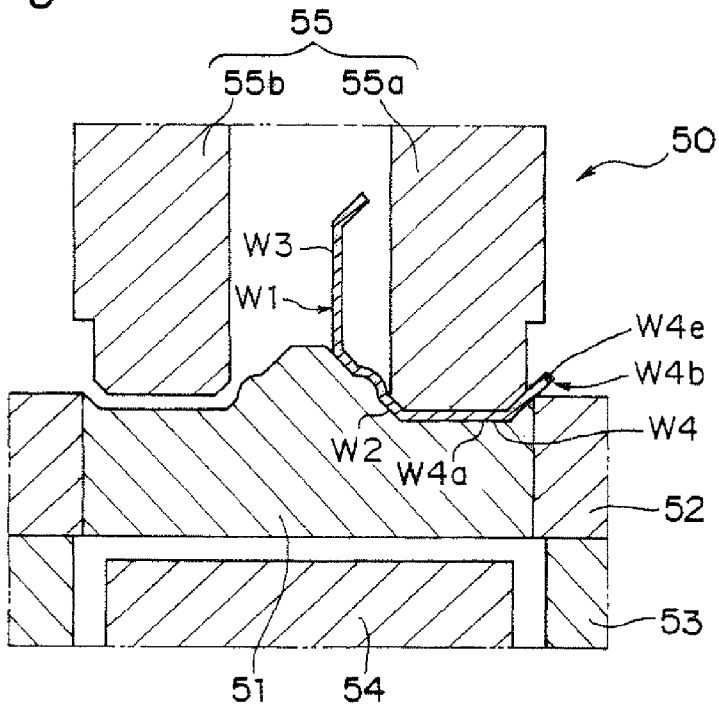
FIG. 10 is an explanatory diagrams showing an end-bending process.
Figure 11:
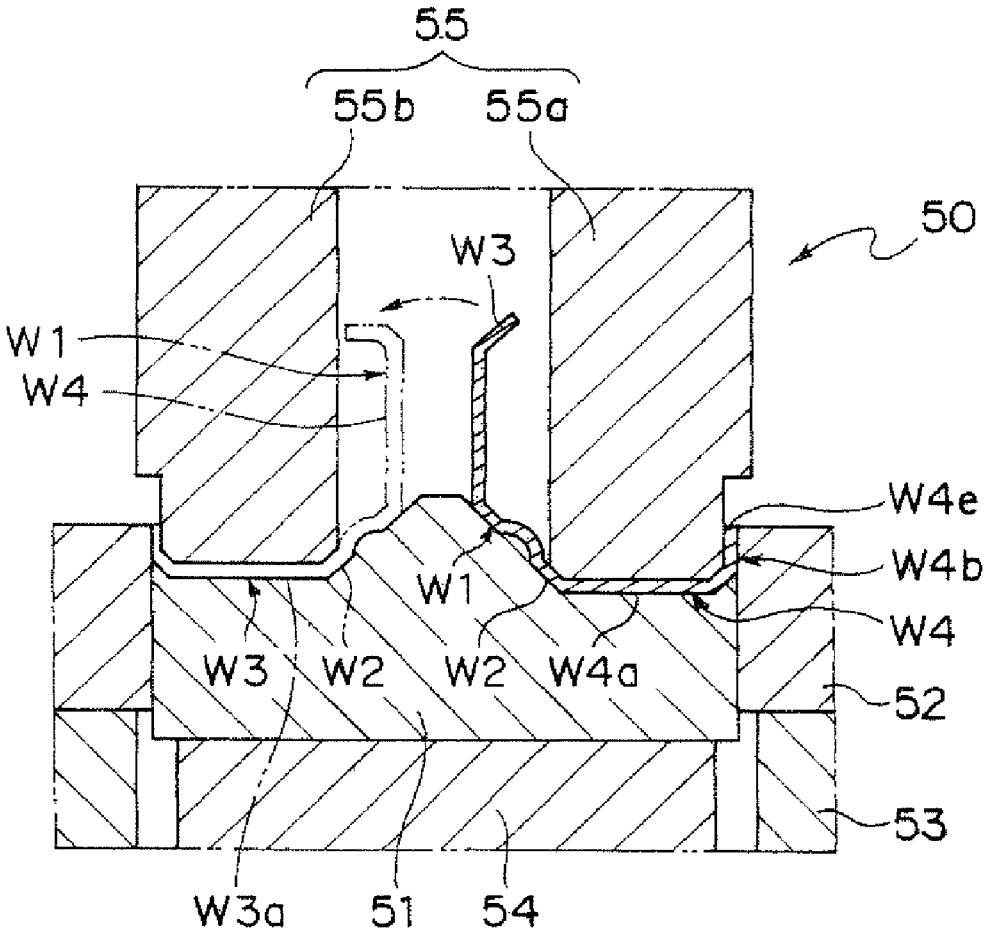
FIG. 11 is an explanatory diagrams showing the end-bending process.

FIGS. 10 and 11 are explanatory diagrams showing an end-bending process, wherein FIG. 10 illustrates a state just after the punch being moved downwardly is brought into contact with the draw-formed plate workpiece, and FIG. 11 illustrates a state after the punch is further moved downwardly, and the end of the protruded sidewall of the draw-formed plate workpiece is bent.

As shown in FIG. 10, when the punch 55 is moved downwardly under a condition that the draw-formed plate workpiece W1 is held on the upper surface 51*b* of the first die 51, the right punch member 55*a* of the punch 55 is brought into contact with the draw-formed plate workpiece W1. When the punch 55 is further moved downwardly from the position illustrated in FIG. 10, the end W4*e* of the second right sidewall portion W4*b* of the protruded sidewall W4 is gradually bent inwardly by an interaction between the right punch member 55*a* and the second die 52 under a condition that the draw-formed plate workpiece W1 is clamped between the right punch member 55*a* of the punch 55 and the first die 51. Then, as shown in FIG. 11, when the first die 51 is brought into contact with the fourth die 54, the downward movement of the punch 55 is stopped, and the end-bending process for the end W4*e* is completed.

After the completion of the end-bending of the end W4*e* of the protruded sidewall W4 of the draw-formed plate workpiece W1, the first die 51 and the draw-formed plate workpiece W1 held on the first die 51 are moved upwardly to their initial positions. Then, as indicated by the two-dot chain line in FIG. 11, the draw-formed plate workpiece W1 is turned 90 degrees, and held on the left region of the upper surface 51*b* of the first die 51 in a posture where the first right sidewall portion W3*a* is located at the lowermost position. Subsequently, in the same manner as that described above, the end W3*e* of the second left sidewall portion W3*b* of the protruded sidewall W3 is bent inwardly by an interaction between the left punch member 55*a* and the second die 52.

After the ends W3*e*, W4*e* of the protruded sidewalls W3, W4 of the draw-formed plate workpiece W1 each located on the side opposite to the protruded top wall W2 are bent inwardly, the draw-formed plate workpiece W1 is press-formed to allow the convex wall portion W2*a* of the protruded top wall W2 to be pressed in the convexly protruding direction of the draw-formed plate workpiece W1, i.e., in a direction opposite to the protruding direction of the convex wall portion W2*a*, and formed into a given shape, so that the protruded sidewalls W3, W4 located on the respective ones of both sides to the protruded top wall W2 are displaced inwardly and cross-sectionally closed together.

Figure 12A:
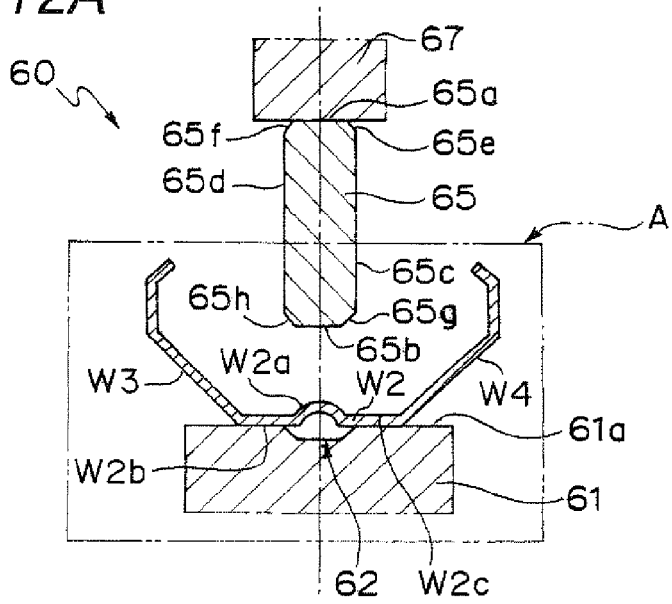
FIGS. 12A to 12C are explanatory diagrams showing a press-forming process.
Figure 12B:
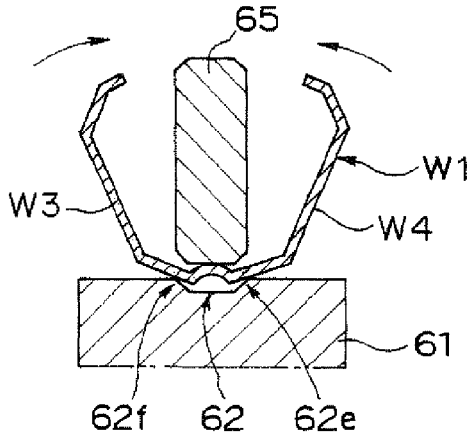
Figure 12C:
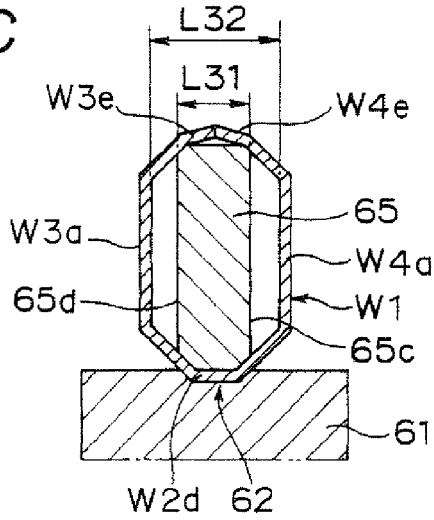

FIGS. 12A to 12C are explanatory diagrams showing a press-forming process, wherein FIG. 12A, FIG. 12B and FIG. 12C show, respectively, a state just after the draw-formed plate workpiece W1 is held on a press-forming die assembly of a press-forming apparatus for press-forming the draw-formed plate workpiece W1 into a cross-sectionally closed shape, a state when the convex wall portion of the protruded top wall of the draw-formed plate workpiece is being press-formed using a core die of the press-forming die assembly, and a state after the convex wall portion of the protruded top wall of the draw-formed plate workpiece is press-formed into a given shape by the core die of the press-forming die assembly so that the respective ends of the protruded sidewalls are butted together in such a manner that the protruded sidewalls are cross-sectionally closed together. In FIGS. 12B and 12C, a punch of the press-forming die assembly is omitted.

As shown in FIG. 12A, the press-forming die assembly (second forming die assembly) 60 of the press-forming apparatus for press-forming the draw-formed plate workpiece W1 into a cross-sectionally closed shape comprises a receiving die 61 for holding the draw-formed plate workpiece W1, a core die 65 disposed above the receiving die 61 and adapted to be movable in an upward-downward direction, and a punch 67 disposed above the core die 65 and adapted to be movable in the upward-downward direction.

Figure 13:
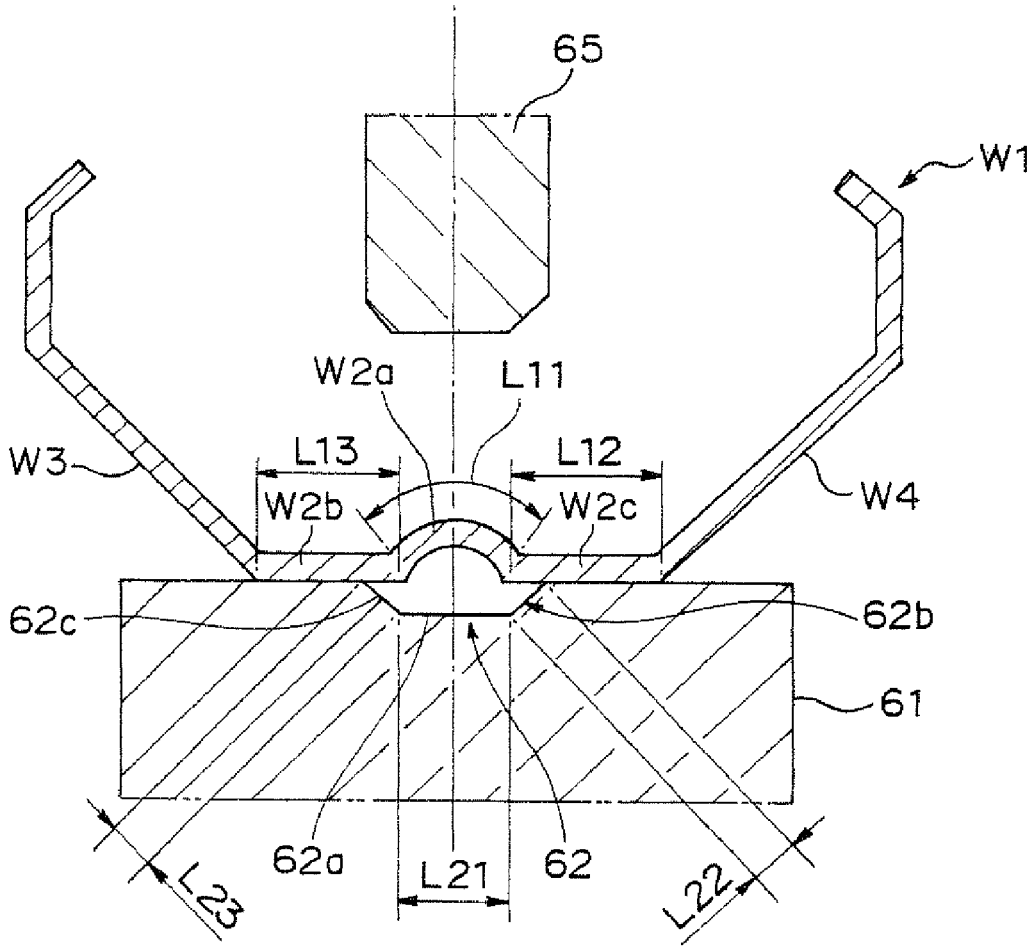
FIG. 13 is a fragmentary enlarged view showing an area A in FIG. 12A.

The receiving die 61 of the press-forming die assembly 60 has an upper surface 61*a* for holding the protruded top wall W2 of the draw-formed plate workpiece W1, and a concave portion 62 is concavely formed in the upper surface 61*a*, as shown in FIG. 12A. FIG. 13 is a fragmentary enlarged view showing an area A in FIG. 12A. As shown in FIG. 13, the concave portion 62 provided in the receiving die 61 of the press-forming die assembly 60 has a bottom surface 62*a*, and two opposed side surfaces 62*b*, 62*c*, specifically a right side surface 62*a* located on a right side in FIG. 13 and a left side surface 62*c* located on a left side in FIG. 13, wherein the concave portion extends in a longitudinal direction of the receiving die 61.

The bottom surface 62*a* of the concave portion 62 provided in the receiving die 61 of the press-forming die assembly 60 is formed in conformity to a shape of the bottom wall 22 of the front side frame 20, to have a cross-sectional length of the convex wall portion W2*a* of the protruded sidewall W2 of the draw-formed plate workpiece W1, i.e., a cross-sectional length L21 approximately equal to an arc length L11 of the convex wall portion W2*a* in cross-section. Each of the side surfaces 62*b*, 62*c* of the concave portion 62 is formed to have a cross-sectional length approximately equal to a shortest one of a plurality of cross-sectional lengths of the protruded top wall W2 which change in the longitudinal direction of the draw-formed plate workpiece W1. Specifically, the right side surface 62*b* of the concave portion 62 is formed to have a cross-sectional length L22 approximately equal to a shortest one of a plurality of cross-sectional lengths L12 of the left top wall portion W2*c*, and the left side surface 62*c* of the concave portion 62 is formed to have a cross-sectional length L23 approximately equal to a shortest one of a plurality of cross-sectional lengths L13 of the right top wall portion W2*b*. Further, each of the side surfaces 62*b*, 62*c* of the concave portion 62 is formed such that an inclination angle thereof relative to the bottom surface 62*a* has a given constant value in the longitudinal direction, depending on the desired shape of the front side frame 20.

The core die 65 of the press-forming die assembly 60 is disposed above the receiving die 61 to press the protruded top wall W2 of the draw-formed plate workpiece W1, specifically, the convex wall portion W2*a* of the protruded top wall W2, in the convexly protruding direction of the draw-formed plate workpiece W1. The core die 65 is formed to have a longitudinal length greater than that of the draw-formed plate workpiece W1. More specifically, as shown in FIG. 12A, the core die 65 has a top surface 65*a*, a bottom surface 65*b*, a right side surface 65*c*, a left side surface 65*d*, a first inclined side surface 65*e* inclinedly extending from the top surface 65*a* to the right side surface 65*c* obliquely downwardly and rightwardly, a second inclined side surface 65*f* inclinedly extending from the top surface 65*a* to the left side surface 65*d* obliquely downwardly and leftwardly, a third inclined side surface 65*g* inclinedly extending from the bottom surface 65*b* to the right side surface 65*c* obliquely upwardly and rightwardly, and a fourth inclined side surface 65*h* inclinedly extending from the bottom surface 65*b* to the left side surface 65*d* obliquely upwardly and leftwardly. Each of the bottom surface 65*b*, the third inclined side surface 65*g* and the fourth inclined side surface 65*h* in the core die 65 is formed in conformity to a shape of a corresponding one of the bottom wall 22, the third inclined sidewall 27 and the fourth inclined sidewall 28 in the front side frame 20. Further, each of the top surface 65*a*, the first inclined side surface 65*e* and the second inclined side surface 65*f* of the core die 65 is formed in conformity to a shape of a corresponding one of the top wall 21, the first inclined sidewall 25 and the second inclined sidewall 26 in the front side frame 20.

The core die 65 of the press-forming die assembly 60 is formed to have a cross-sectional width less than that of the front side frame 20 when the draw-formed plate workpiece W1 is press-formed into a cross-sectionally closed shape. More specifically, as shown in FIG. 12C, the core die 65 is formed such that a cross-sectional width L31 thereof between the right side surface 65*c* and the left side surface 65*d* becomes less than a cross-sectional width L32 between the first left sidewall portion W4*a* and the first right sidewall portion W3*a* of the draw-formed plate workpiece W1, which corresponds to a cross-sectional width between the right sidewall 23 and the left sidewall 24 of the front side frame 20. A cross-sectional lateral length or width of the bottom surface 65*d* of the core die 65 is set to be approximately equal to the cross-sectional length L11 of the convex wall portion W2*a* of the draw-formed plate workpiece W1. The core die 65 is adapted, after the draw-formed plate workpiece W1 is press-formed into a cross-sectionally closed shape, to be pulled out from the draw-formed plate workpiece W1 in the longitudinal direction of the draw-formed plate workpiece W1.

The punch 67 of the press-forming die assembly 60 is designed, after the respective ends W3*e*, W4*e* of the protruded sidewalls W3, W4 of the draw-formed plate workpiece W1 are butted together in such a manner that the protruded sidewalls W3, W4 are cross-sectionally closed together, to perform a final press-forming process of pressing the butted ends W3*e*, W4*e* of the protruded sidewalls W3, W4 against the surface (top surface) 65*a* of the core die 65 on an opposite side of the surface (bottom surface) 65*b* used for pressing the protruded top wall W2 (specifically, the convex wall portion W2*a*), as described later. The punch 67 is disposed immediately above the core die 65 and adapted to be movable in the upward-downward direction.

The press-forming apparatus equipped with the above press-forming die assembly 60 is operable, under a condition that the draw-formed plate workpiece W1 is held on the receiving die 61 of the press-forming die assembly 60 while placing the convex wall portion W2*a* of the draw-formed plate workpiece W1 on the concave portion 62 of the receiving die 61, to allow the convex wall portion W2*a* of the draw-formed plate workpiece W1 to be press in the convexly protruding direction of the draw-formed plate workpiece W1 and formed into a given shape within the concave portion 62 by the core die 65 of the press-forming die assembly 60, so that the protruded sidewalls W3, W4 located on the respective ones of both sides of the protruded top wall W2 of the draw-formed plate workpiece W1 are displaced toward the inwardly and cross-sectionally closed together.

In the press-forming of the convex wall portion W2*a* of the draw-formed plate workpiece W1 within the concave portion 62, the draw-formed plate workpiece W1 is placed on the receiving die 61 of the press-forming die assembly 60 to allow a lateral center of the convex wall portion W2*a* of the draw-formed plate workpiece W1 to be located approximately on a vertical axis of the concave portion 62 of the receiving die 61, and the protruded top wall W2 of the draw-formed plate workpiece W1 is held on the upper surface 61*a* of the receiving die 61, as shown in FIG. 12A.

After the draw-formed plate workpiece W1 is held on the receiving die 61, the core die 65 is moved downwardly to press the convex wall portion W2*a* of the draw-formed plate workpiece W1 downwardly, i.e., in the convexly protruding direction of the draw-formed plate workpiece W1, so that the left top wall W2*c* and the protruded sidewall W4 are displaced inwardly, i.e., in a direction allowing the draw-formed plate workpiece W1 to have a cross-sectionally closed shape, about a shoulder 62*e* of the receiving die 61 which is an intersection between the right side surface 62*b* of the concave portion 62 and the upper surface 61*a*, and the right top wall W2*b* and the protruded sidewall W3 are simultaneously displaced inwardly, i.e., in a direction allowing the draw-formed plate workpiece W1 to have a cross-sectionally closed shape, about a shoulder 62*f* of the receiving die 61 which is an intersection between the left side surface 62*c* of the concave portion 62 and the upper surface 61*a*, as shown in FIG. 12B.

When the core die 65 is further moved downwardly to press the convex wall portion W2*a* of the draw-formed plate workpiece W1 within the concave portion 62 of the receiving die 61, the convex wall portion W2*a* is flattened and formed as a press-formed wall W2*d* by an interaction between the punch 65 and the receiving die 61, and the protruded sidewalls W3, W4 on the respective ones of both sides of the protruded top wall W2 are further displaced inwardly to allow the respective ends W3*e*, W4*e* of the protruded sidewalls W3, W4 to be butted together in such a manner that the protruded sidewalls W3, W4 are cross-sectionally closed together, as shown in FIG. 12C.

Figure 14A:
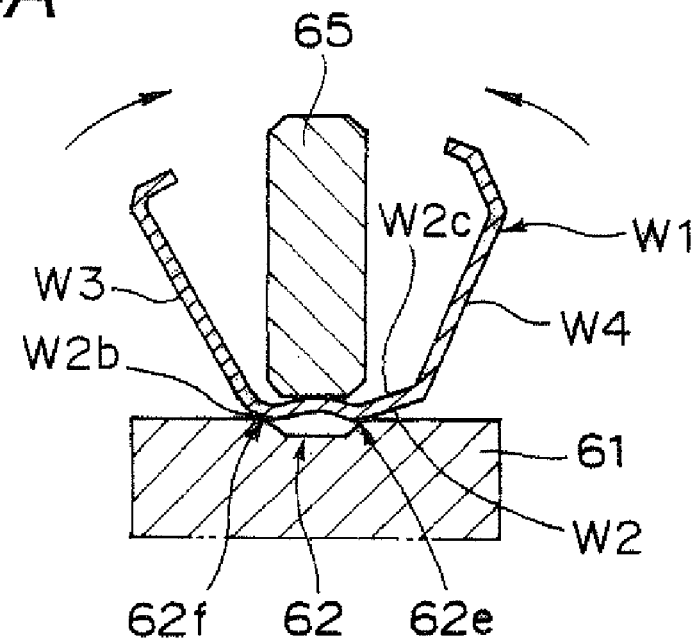
FIGS. 14A and 14B are explanatory diagrams showing the press-forming process in a cross-section corresponding to that illustrated in FIG. 3B.
Figure 14B:
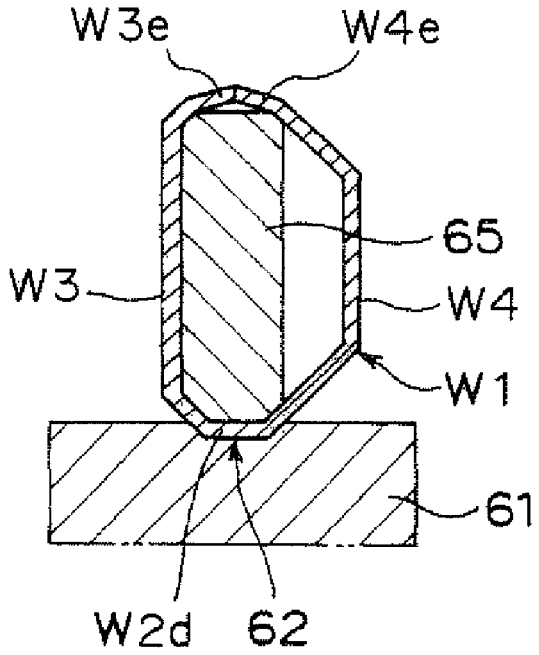

Although each of FIGS. 12A to 12C for illustrating the press-forming process shows a cross-section corresponding to that illustrated in FIG. 3A, a remaining portion of the draw-formed plate workpiece W1 in any other cross-section, such as a cross-section corresponding to that illustrated in FIG. 3B is simultaneously pressed and formed into a cross-sectionally closed shape. FIGS. 14A and 14B are explanatory diagrams showing the press-forming process in a cross-section corresponding to that illustrated in FIG. 3B, wherein FIG. 14A illustrates a state when the convex wall portion of the protruded top wall of the draw-formed plate workpiece is being pressed by the core die of the press-forming die assembly, and FIG. 14B illustrates a state after the convex wall portion of the protruded top wall of the draw-formed plate workpiece is press-formed into a given shape by the core die of the press-forming die assembly to allow the respective ends of the protruded sidewalls to be butted together in such a manner that the protruded sidewalls are cross-sectionally closed together.

In the cross-section corresponding to that illustrated in FIG. 3B, when the core die 65 is moved downwardly under a condition that the draw-formed plate workpiece W1 is held on the receiving die 61 while allowing the convex wall portion W2*a* of the draw-formed plate workpiece W1 to be placed on the concave portion 62 of the receiving die 61, the convex wall portion W2*a* of the draw-formed plate workpiece W1 is pressed downwardly, i.e., in the convexly protruding direction of the draw-formed plate workpiece W1, by the core die 65, so that the left top wall portion W2*c* and the protruded sidewall W4 are displaced inwardly, i.e., in a direction allowing the draw-formed plate workpiece W1 to have a cross-sectionally closed shape, about the shoulder 62*e* of the receiving die 61, and the right top wall W2*b* and the protruded sidewall W3 are displaced inwardly, i.e., in a direction allowing the draw-formed plate workpiece W1 to have a cross-sectionally closed shape, about the shoulder 62*f* of the receiving die 61, as shown in FIG. 14A, in the same manner as that in FIG. 12B.

When the core die 65 is further moved downwardly to press the convex wall portion W2*a* of the draw-formed plate workpiece W1 within the concave portion 62 of the receiving die 61, the convex wall portion W2*a* is flattened and formed as the press-formed wall W2*d*, by an interaction between the punch 65 and the receiving die 61, and the protruded sidewalls W3, W4 on the respective ones of both sides of the protruded top wall W2 are further displaced inwardly to allow the respective ends W3*e*, W4*e* of the protruded sidewalls W3, W4 to be butted together in such a manner that the protruded sidewalls W3, W4 are cross-sectionally closed together, as shown in FIG. 14B, in the same manner as that in FIG. 12C.

In the first embodiment, the wall portions W2*c*, W2*b* of the protruded top wall W2 divided by the convex wall portion W2*a* are formed such that each of the cross-sectional lengths L12, L13 thereof changes in the longitudinal direction of the draw-formed plate workpiece W1, and press-formed using the receiving die 61 of the press-forming die assembly 60 configured such that each of the cross-sectional lengths L22, L23 of the side surfaces 62*b*, 62*c* of the concave portion 62 provided in the receiving die 61 is set to be approximately equal to a shortest one of the cross-sectional lengths L12, L13 of a corresponding one of the wall portions W2*c*, W2*b* of the protruded top wall W2. Thus, the top wall portions W2*c*, W2*b* corresponding to respective sidewalls to be formed on the respective ones of both sides of the press-formed wall W2*d*, specifically, respective ones of the third inclined sidewall 27 and the fourth inclined sidewall 28 of the front side frame 20, can be press-formed at approximately the same timing in the longitudinal direction. This makes it possible to stably perform the press-forming.

As shown in FIGS. 12C and 14B, after pressing the convex wall portion W2*a* of the draw-formed plate workpiece W1 in the convexly protruding direction of the draw-formed plate workpiece W1 by the core die 65, to allow the convex wall portion W2*a* to be flattened and formed as the press-formed wall W2*d* within the concave portion 62, so that the protruded sidewalls W3, W4 on the respective ones of both sides of the protruded top wall W2 are displaced inwardly and cross-sectionally closed together in a butted manner, a final press-forming process is performed to press the butted ends W3*e*, W4*e* of the protruded sidewalls W3, W4 against the surface 65*a* of the core die 65 on an opposite side of the surface 65*b* used for pressing the convex wall portion W2*a*.

Figure 15A:
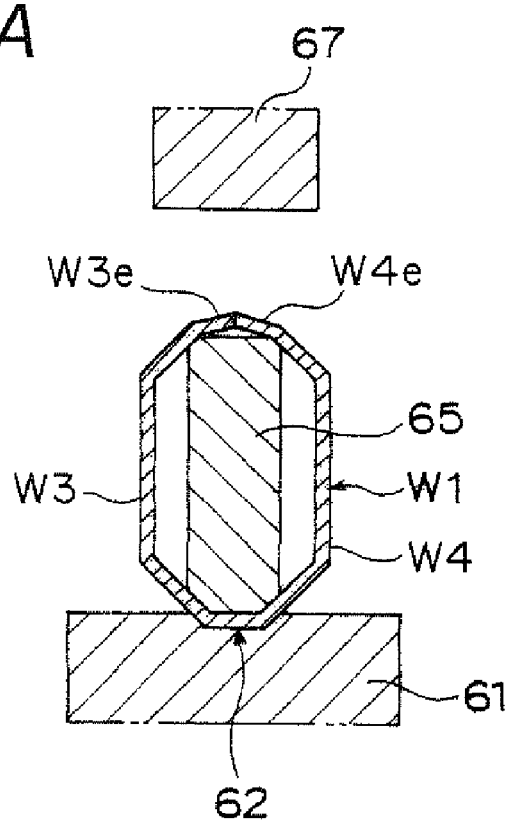
FIGS. 15A and 15B are explanatory diagrams showing a final press-forming process.
Figure 15B:
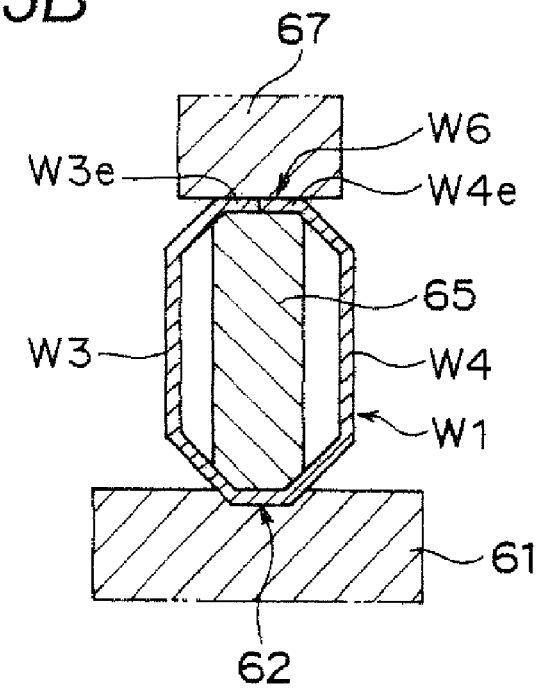

FIGS. 15A and 15B are explanatory diagrams showing the final press-forming process, wherein FIG. 15A illustrates a state before the final press-forming, and FIG. 15B illustrates a state after the final press-forming. In the final press-forming process of pressing the butted ends W3*e*, W4*e* of the protruded sidewalls W3, W4 of the draw-formed plate workpiece W1 against the core die 65, as shown in FIG. 15A, the punch 67 is used which is disposed immediately above the core die 65 and adapted to be movable in the upward-downward direction.

Specifically, when the punch 67 of the press-forming die assembly 60 is moved downwardly to press the respective butted ends W3*e*, W4*e* of the protruded sidewalls W3, W4 of the draw-formed plate workpiece W1, the butted ends W3*e*, W4*e* of the protruded sidewalls W3, W4 of the draw-formed plate workpiece are pressed by the punch 67, and pressed against the surface 65*a* on the side opposite to the surface 65*b* of the core die 65 used for pressing the convex wall portion W2*a*, and formed as a wall W6 corresponding to the top wall 21 of the front side frame 20, as shown in FIG. 15B.

As above, the method according to the first embodiment includes the final press-forming process of pressing the butted ends W3*e*, W4*e* of the protruded sidewalls W3, W4 of the draw-formed plate workpiece W1 against the surface 65*a* on the side opposite to the surface 65*b* of the core die 65 used for pressing the convexly curving wall W2*a*. This makes it possible to achieve a high degree of forming accuracy in a relatively simple manner, even in a wall on the side opposite to the press-formed wall W2*d*.

After the final press-forming for the butted ends W3*e*, W4*e* of the protruded sidewalls W3, W4 of the draw-formed plate workpiece W1, the butted ends of the protruded sidewalls are joined together by welding, such as laser welding, so that the front side frame 20 as a metal closed-section member formed in a cross-sectionally closed shape is produced without providing a flange portion thereto.

As above, the method according to the first embodiment includes the welding process of mutually welding the respective ends of the cross-sectionally-closed protruded sidewalls of the draw-formed plate workpiece. This makes it possible to increase joint strength of a metal closed-section member to produce a stronger metal closed-section member.

In the first embodiment, under the condition that the plate workpiece W1 is clamped between the die 45 and the blank holder 41 of the draw-forming die assembly 40, the punch 42 is moved into the forming space 45*c* of the die 45 to draw-form the plate workpiece W1 into a shape convexly protruding in the direction of the movement of the punch 42 relative to the die 45, while allowing the convex wall portion W2*a* protruding in the direction opposite to the convexly protruding direction of the draw-formed plate workpiece W1 to be formed in the protruded top wall W2 of the draw-formed plate workpiece W1. Instead of the draw-forming, any other suitable press-forming process, such as stretch-forming, may be employed.

In the first embodiment, the ends W3*e*, W4*e* of the protruded sidewalls W3, W4 of the draw-formed plate workpiece W1 are bended, and then the protruded sidewalls W3, W4 are cross-sectionally closed together. Alternatively, the protruded sidewalls W3, W4 may be cross-sectionally closed together without bending the ends W3*e*, W4*e*.

In the first embodiment, the convex wall portion W2*a* of the draw-formed plate workpiece W1 is pressed within the concave portion 62 in the convexly protruding direction of the draw-formed plate workpiece W1 by the core die 65 of the press-forming die assembly 60, in such as manner as to be butted together to allow the protruded sidewalls W3, W4 to be cross-sectionally closed together. Alternatively, the ends W3*e*, W4*e* of the protruded sidewalls W3, W4 of the draw-formed plate workpiece W1 may be superimposed on each other in such a manner that the protruded sidewalls W3, W4 are cross-sectionally closed together. In this case, in the welding process, the superimposed ends W3*e*, W4*e* of the cross-sectionally-closed protruded sidewalls W3, W4 of the draw-formed plate workpiece W1 are preferably joined together by lap welding or fillet welding.

In the first embodiment, the concave portion 62 is formed in the receiving die 61 of the press-forming die assembly 60. Alternatively, the plate workpiece W1 may be held on the receiving die 61 to allow the convex wall portion W2*a* of the draw-formed plate workpiece W1 to be placed on a flat portion of the receiving die 61 without forming the concave portion in the receiving die 61. Then, in this state, the convex wall portion W2*a* of the draw-formed plate workpiece W1 may be pressed against the flat portion of the receiving die 61 of the press-forming die assembly 60 in the convexly protruding direction of the draw-formed plate workpiece W1 by the core die 65 of the press-forming die assembly 60, in such a manner as to be flattened and formed as a press-formed wall, so that the protruded sidewalls W3, W4 of the draw-formed plate workpiece W1 are displaced toward the inward side of the draw-formed plate workpiece W1 and cross-sectionally closed together.

As described above, the production method for the front side frame 20 as a metal closed-section member, according to the first embodiment, comprises a first press-forming step of, under a condition that a metal plate workpiece W1 is clamped between a die 45 and a blank holder 41 of a first forming die assembly 40, moving a punch 42 of the first forming die assembly 40 into a forming space 45*c* of the die 45 to press-form the plate workpiece W1 into a shape convexly protruding in a direction of the movement of the punch 42 relative to the die 45, and a second press-forming step of after the first press-forming step, under a condition that the press-formed plate workpiece W1 is positioned between a receiving die 61 and a core die 65 of a second forming die assembly 60, wherein the core die 65 is disposed on the side opposite to the convexly protruding direction of the press-formed plate workpiece W1, moving the core die 65 relative to the receiving die 61 to allow a protruded top wall W2 of the press-formed plate workpiece W1 formed in a convex shape to be pressed in the convexly protruding direction of the press-formed plate workpiece W1 and formed into a given shape, so that two protruded sidewalls W3, W4 of the press-formed plate workpiece W1 formed on respective ones of both sides of the protruded top wall W2 during the first press-forming step are displaced toward an inward side of the press-formed plate workpiece W1 and cross-sectionally closed together. This makes it possible to accurately produce a metal closed-section member in a relatively simple manner while preventing the occurrence of crimples in the plate workpiece.

The first press-forming step includes forming, in the protruded top wall W2 of the press-formed plate workpiece W1, a convex wall portion W2*a* protruding in a direction opposite to the convexly protruding direction of the press-formed plate workpiece W1, and the second press-forming step includes pressing the convex wall portion W2*a* of the press-formed plate workpiece W1 to allow the convex wall portion W2*a* of the press-formed plate workpiece W1 to be flattened and formed as a press-formed wall W2*d*, so that the protruded sidewalls W3, W4 of the press-formed plate workpiece W1 on the respective ones of both sides of the protruded top wall W2 are displaced toward the inward side of the press-formed plate workpiece W1 and cross-sectionally closed together. This makes it possible to obtain the above advantages in a relatively simple manner without causing structural complexity in a forming apparatus, such as a forming die assembly. Further, even in a metal closed-section member having a cross-sectional shape which changes in a longitudinal direction thereof, there is no need to employ a forming die adapted to surround a metal closed-section member. Thus, a metal closed-section member can be produced from a metal plate workpiece in a relatively simple manner.

In the first embodiment, the convex wall portion W2*a* of the protruded top wall W2 of the press-formed plate workpiece W1 is formed in a cross-sectionally arc shape, and pressed to allow the protruded sidewalls W3, W4 on respective ones of both side of the protruded top wall of the press-formed plate workpiece W1 to be displaced toward the inward side of the press-formed plate workpiece W1. Alternatively, the convex wall portion of the protruded top wall W2 of the press-formed plate workpiece W1 may be formed in a cross-sectionally trapezoidal shape.

As above, the convex wall portion W2*a* of the protruded top wall W2 of the press-formed plate workpiece W1 may be formed in a cross-sectionally arc or trapezoidal shape. This makes it possible to prevent the occurrence of crack or the like when the convex wall portion W2*a* is flattened, to effectively obtain the above advantages.

Further, a cross-sectional length of the convex wall portion W2*a* of the protruded top wall W2 of the press-formed plate workpiece W1 is approximately equal to that of the press-formed wall W2*d*. This makes it possible to accurately form the press-formed wall to effectively obtain the above advantages.

In the first embodiment, both the ends W3*e*, W4*e* of the protruded sidewalls W3, W4 of the press-formed plate workpiece W1 on the side opposite to the protruded top wall W2 are bent. Alternatively, only one of the ends W3*e*, W4*e* of the protruded sidewalls of the press-formed plate workpiece W1 on the side opposite to the protruded top wall may be bent inwardly.

More specifically, the method according to the first embodiment includes an end-bending step of, between the first press-forming step and the second press-forming step, bending at least one of respective ends W3*e*, W4*e* of the protruded sidewalls W3, W4 of the press-formed plate workpiece W1 on the side opposite to the protruded top wall W2, toward the inward side of the press-formed plate workpiece W1. This makes it possible to reduce displacement of the press-formed plate workpiece toward the inward side of the protruded sidewalls when the press-formed plate workpiece is formed into a cross-sectionally closed shape, to further accurately produce a metal closed-section member.

The core die 65 having a cross-sectional width L31 less than that L32 of the front side frame 20 is used to press-form the press-formed plate workpiece W1 into a cross-sectionally closed shape. Thus, in case where a convex wall portion protruding toward an inward side of a closed-section space of the press-formed plate workpiece W1 is also formed in at least one of the protruded sidewall W3, W4, this feature makes it possible to prevent interference between the core die and the convex wall portion formed in the at least one protruded sidewall, in the second press-forming step for forming the press-formed plate workpiece W1 into a cross-sectionally closed shape.

In the first embodiment, under the condition that the press-formed plate workpiece W1 is positioned between the receiving die 61 and the core die 65 of the second forming die assembly 60, wherein the core die 65 is disposed on the side opposite to the convexly protruding direction of the press-formed plate workpiece W1, the core die 65 is moved relative to the receiving die 61 to allow the protruded top wall W2 of the press-formed plate workpiece W1 to be pressed in the convexly protruding direction of the press-formed plate workpiece W1 and formed into a given shape, so that the protruded sidewalls W3, W4 of the press-formed plate workpiece W1 formed on the respective ones of both sides of the protruded top wall W2 during the first press-forming step are displaced toward the inward side of the press-formed plate workpiece W1 and cross-sectionally closed together. Alternatively, the receiving die 61 may be moved relative to the core die 65 to allow the protruded sidewalls W3, W4 of the press-formed plate workpiece W1 formed on the respective ones of both sides of the protruded top wall W2 during the first press-forming step to be displaced toward the inward side of the press-formed plate workpiece W1 and cross-sectionally closed together.

With reference to FIGS. 16 to 26C, a metal closed-section member production method according to a second embodiment of the present invention will be described below.

Figure 16:
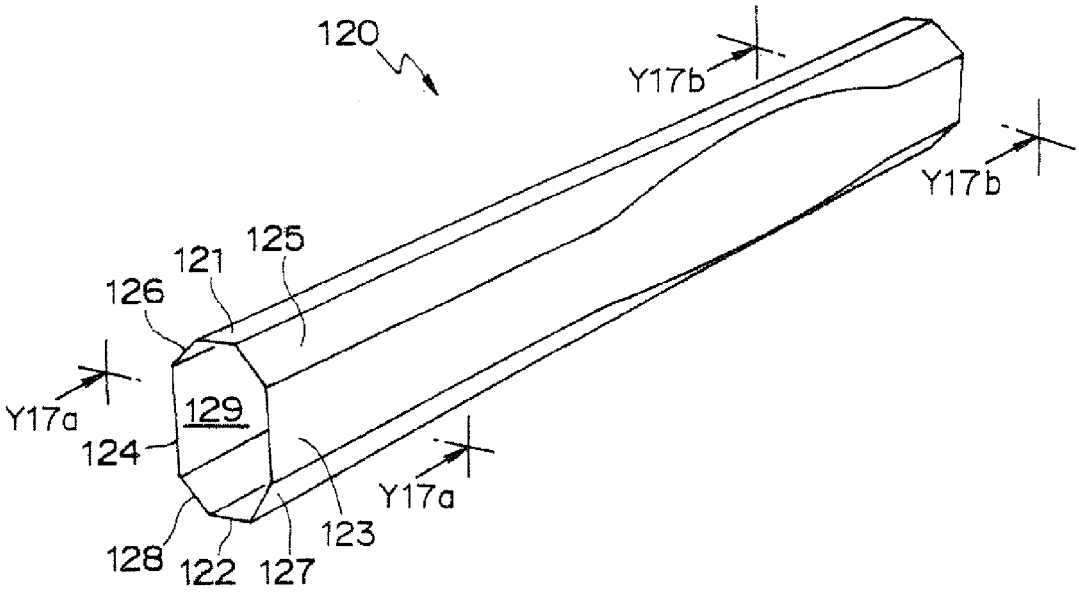
FIG. 16 is a perspective view showing a front side frame as a metal closed-section member produced by a method according to a second embodiment of the present invention.
Figure 17A:
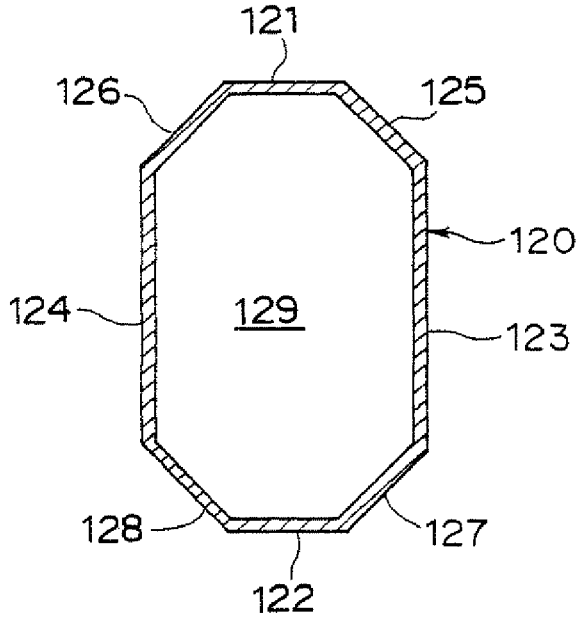
FIG. 17A is a sectional view of the front side frame, taken along the line Y17*a*-Y17*a* in FIG. 16.

FIG. 16 is a perspective view showing a front side frame as a metal closed-section member produced by the method according to the second embodiment. FIG. 17A is a sectional view of the front side frame, taken along the line Y17*a*-Y17*a* in FIG. 16, and FIG. 17B is a sectional view of front side frame, taken along the line Y17*b*-Y17*b* in FIG. 16.

As shown in FIG. 16, the front side frame 120 as a metal closed-section member produced by the method according to the second embodiment has the same structure as that of the front side frame 20, except that the front side frame 120 has no bead. The front side frame 120 is formed as a metal member having a longitudinally long and cross-sectionally closed shape. More specifically, the front side frame 120 is formed in a cross-sectionally octagonal shape to have a hollow space 129 defined by a top wall 121, a bottom wall 122, a right sidewall 123, a left sidewall 124, a first inclined sidewall 125 inclinedly extending from the top wall 121 obliquely downwardly and rightwardly to the right sidewall 123, a second inclined sidewall 126 inclinedly extending from the top wall 121 obliquely downwardly and leftwardly to the left sidewall 124, a third inclined sidewall 127 inclinedly extending from the bottom wall 122 obliquely upwardly and rightwardly to the right sidewall 123, and a fourth inclined sidewall 128 inclinedly extending from the bottom wall 122 obliquely upwardly and leftwardly to the left sidewall 124.

Figure 17B:
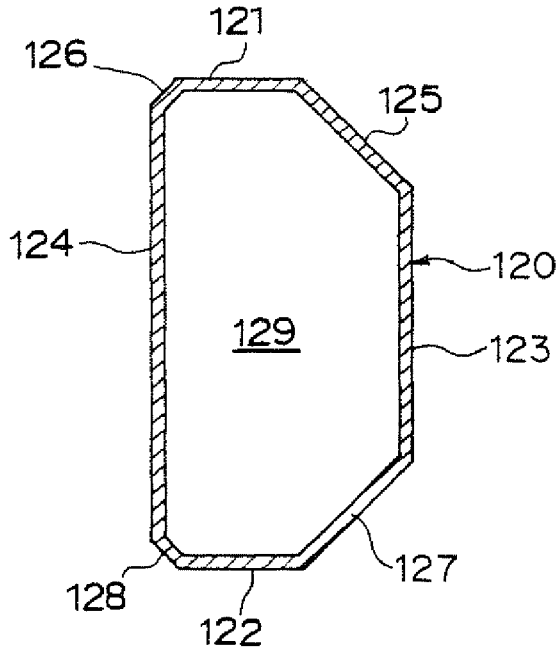
FIG. 17B is a sectional view of front side frame, taken along the line Y17*b*-Y17*b* in FIG. 16.

The front side frame 120 is formed such that the top wall 121 and the bottom wall 122 extend in parallel along a longitudinal direction of the front side frame 120 and have approximately the same cross-sectional length, whereas a cross-sectional shape thereof changes in the longitudinal direction, as shown in FIGS. 16, 17A and 17B. Specifically, the front side frame 120 is formed such that each of the first inclined sidewall 125 and the third inclined sidewall 127 in the cross-section illustrated in FIG. 17A has a cross-sectional length less than that of a corresponding one of the first inclined sidewall 125 and the third inclined sidewall 127 in the cross-section illustrated in FIG. 17B, and the right sidewall 123 in the cross-section illustrated in FIG. 17A has a cross-sectional length greater than that of the right sidewall 123 in the cross-section illustrated in FIG. 17B. Further, the front side frame 120 is formed such that each of the second inclined sidewall 126 and the fourth inclined sidewall 128 in the cross-section illustrated in FIG. 17A has a cross-sectional length greater than that of a corresponding one of the second inclined sidewall 126 and the fourth inclined sidewall 128 in the cross-section illustrated in FIG. 17B, and the left sidewall 124 in the cross-section illustrated in FIG. 17A has a cross-sectional length less than that of the left sidewall 124 in the cross-section illustrated in FIG. 17B.

The method of producing the above front side frame 120 as a metal closed-section member, according to the second embodiment, will be described below.

In the second embodiment, as with the first embodiment, in advance of producing the front side frame 120, a plate workpiece made of a metal material and formed in an approximately flat shape, such as a steel plate, is prepared. Then, the plate workpiece is formed into a convex shape by a press-forming process, specifically a draw-forming process, and further formed into a given shape in conformity to a desired shape of the front side frame 120, through a preliminary end-bending process of preliminarily bending ends of the plate workpiece.

Figure 18:
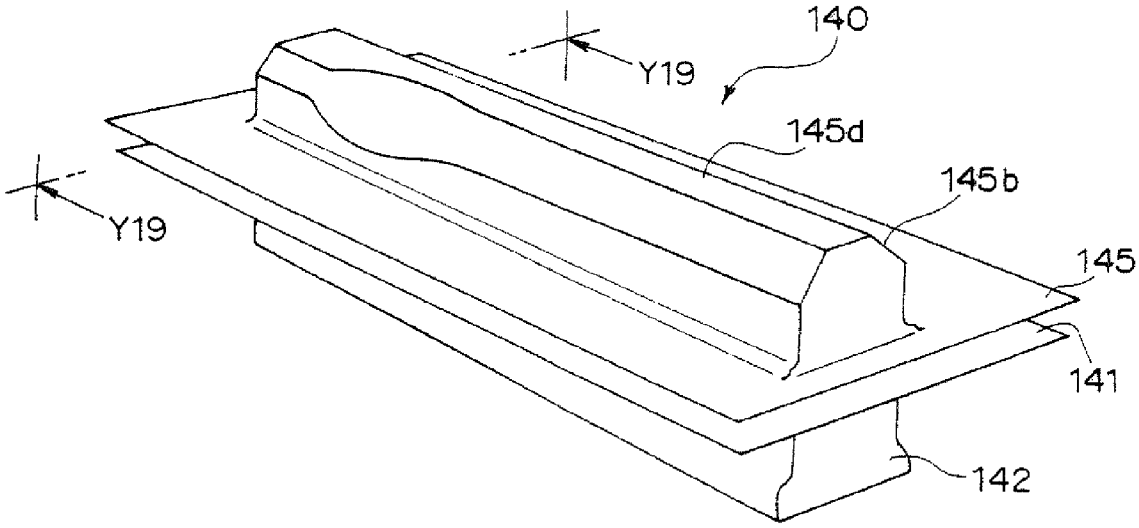
FIG. 18 is a perspective view showing a draw-forming die assembly of a draw-forming apparatus for draw-forming a metal plate workpiece into a given shape.
Figure 19:
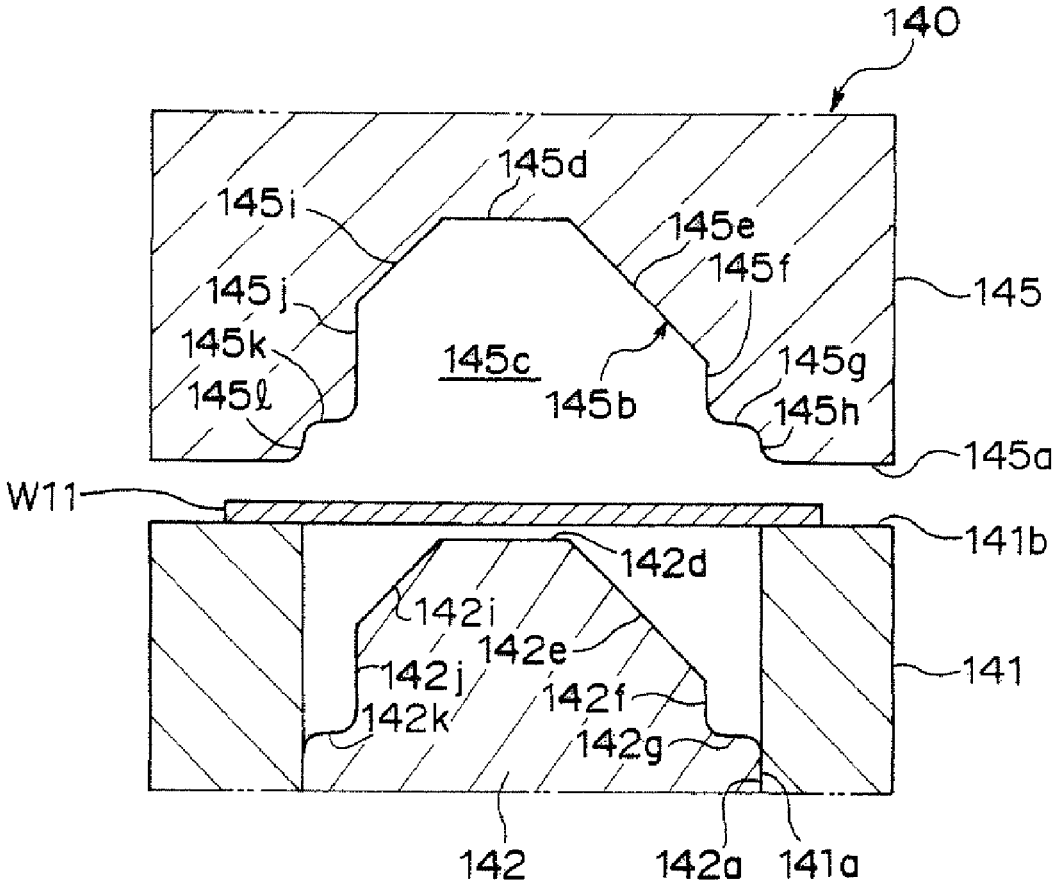
FIG. 19 is a sectional view of the draw-forming die assembly, taken along the line Y19-Y19 in FIG. 18.

FIG. 18 is a perspective view showing a draw-forming die assembly of a draw-forming apparatus for draw-forming a metal plate workpiece into a given shape. FIG. 19 is a sectional view of the draw-forming die assembly, taken along the line Y19-Y19 in FIG. 18. In FIG. 18, in regard to an aftermentioned die of the draw-forming die assembly, only a lower surface thereof is illustrated. Further, in regard to an aftermentioned blank holder of the draw-forming die assembly, only an upper surface thereof is illustrated. In FIG. 19, the plate workpiece is also illustrated.

As shown in FIGS. 18 and 19, the draw-forming die assembly (first forming die assembly) 140 of the draw-forming apparatus for draw-forming a metal plate workpiece W11 into a given shape comprises a blank holder 141 for holding the plate workpiece W11, a punch 412 formed to have an outer peripheral surface 142*a* fitted in an inner peripheral surface 141*a* of the blank holder 141 and adapted to be movable relative to the blank holder 141 in an upward-downward direction, and a die 145 disposed in opposed relation to the blank holder 141 and the punch 142 and adapted to be movable in the upward-downward direction.

The die 145 of the draw-forming die assembly 140 has a concave portion 145*b* concavely formed in a lower surface 145*a* thereof, so that a forming space 145*c* is defined inside the concave portion 145*b* to draw-form the plate workpiece W11 into a given shape. The concave portion 145*b* provided in the die 145 of the draw-forming die assembly 140 is formed in a given shape in conformity to the desired shape of the front side frame 120. Specifically, as shown in FIG. 19, the concave portion 145*b* has a bottom surface 145*d* formed in an approximately flat or horizontal shape, a first inclined surface 145*e* inclinedly extending from the bottom surface 145*d* obliquely downwardly and rightwardly, a first right vertical surface 145*f* extending from the first inclined surface 145*e* vertically downwardly, a right horizontal surface 145*g* extending from the first right vertical surface 145*f* horizontally and rightwardly, a second right vertical surface 145*h* extending from the right horizontal surface 145*g* approximately vertically downwardly, a second inclined surface 145*i* inclinedly extending from the bottom surface 145*d* obliquely downwardly and leftwardly, a first left vertical surface 145*j* extending from the second inclined surface 145*i* vertically downwardly, a left horizontal surface 145*k* extending from the first left vertical surface 145*j* horizontally and leftwardly, and a second left vertical surface 145*l* extending from the left horizontal surface 145*k* approximately vertically downwardly.

The punch 142 of the draw-forming die assembly 140 is formed in a given shape in conformity to the desired shape of the front side frame 120 to form the plate workpiece W11 into a given shape in cooperation with the die 145 of the draw-forming die assembly 140. As shown in FIG. 19, a head of punch 142 has a top surface 142*d* formed in an approximately flat or horizontal shape, a first inclined surface 142*e* inclinedly extending from the top surface 142*d* obliquely downwardly and rightwardly, a right vertical surface 142*f* extending from the first inclined surface 142*e* vertically downwardly, a right horizontal surface 142*g* extending from the right vertical surface 142*f* horizontally and rightwardly, a second inclined surface 142*i* inclinedly extending from the top surface 142*d* obliquely downwardly and leftwardly, a left vertical surface 142*j* extending from the second inclined surface 142*i* vertically downwardly, a left horizontal surface 142*k* extending from the left vertical surface 142*j* horizontally and leftwardly.

The draw-forming apparatus equipped with the above draw-forming die assembly 140 is operable to move the punch 142 into the forming space 145*c* of the die 145 while clamping the plate workpiece W11 between the blank holder 141 and the die 145, to draw-form the plate workpiece W11 into a given shape in conformity to the desired shape of the front side frame 120.

In the draw-forming of the plate workpiece W1 using the draw-forming die assembly 140, under a condition that the blank holder 141 and the die 145 are positioned in spaced-apart relation to each other, and the top surface 142*d* of the punch 142 is positioned below an upper surface 141*b* of the blank holder 141, the plate workpiece W11 is held on the upper surface 41*b* of the blank holder 41, as shown in FIG. 19. Subsequently, the die 145 of the draw-forming die assembly 140 is moved downwardly to clamp opposite lateral (widthwise) ends of the plate workpiece W11 between the blank holder 141 and the die 145, and then the punch 142 is moved upwardly into the forming space 145*c* of the die 145 to draw-form the plate workpiece W11 into a given shape.

Figure 20A:
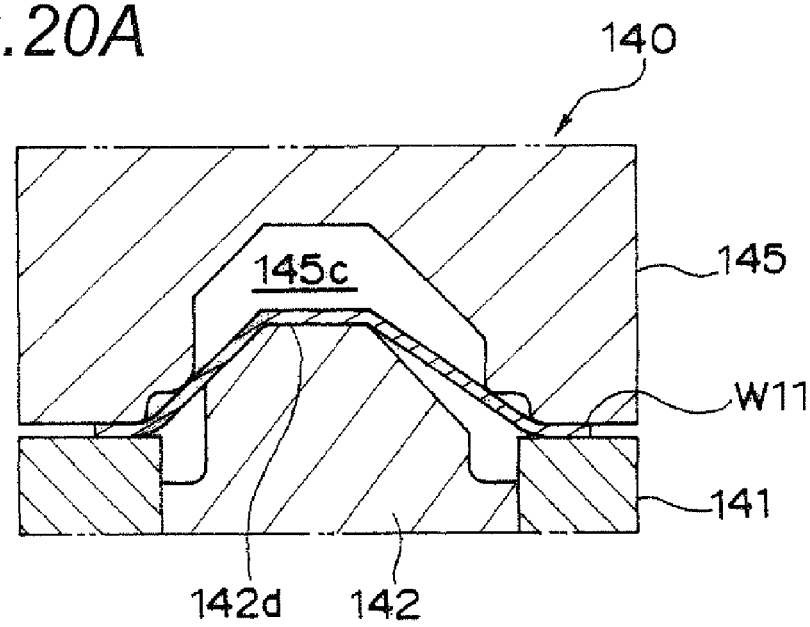
FIGS. 20A and 20B are explanatory diagrams showing a draw-forming process.
Figure 20B:
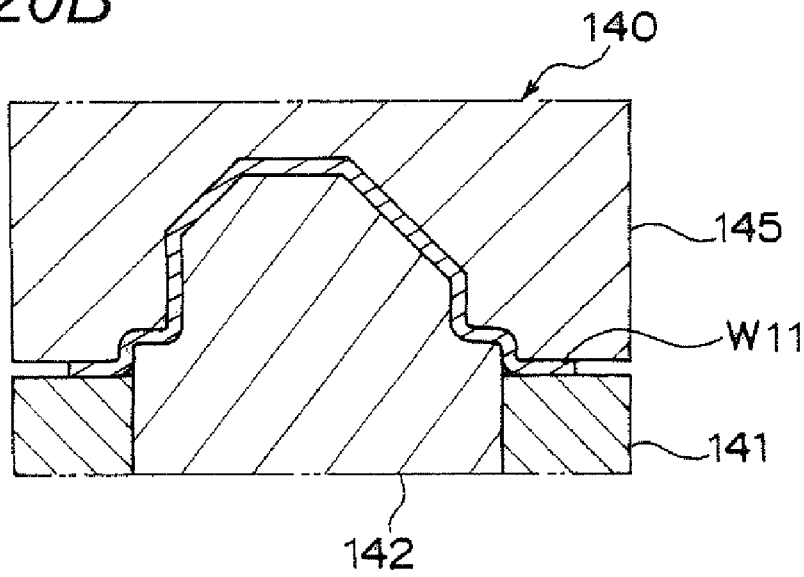

FIGS. 20A and 20B are explanatory diagrams showing a draw-forming process, wherein FIG. 20A illustrates a state when the punch is being moved upwardly after the plate workpiece is clamped between the blank holder and the die, to draw-form the plate workpiece into an intermediate shape, and FIG. 20B illustrates a state after the punch is fully moved upwardly to further draw-form the plate workpiece into a final shape.

As shown in FIG. 20A, when the punch 142 is being moved into the forming space 145*c* of the die 145 under a condition that the plate workpiece W11 is clamped between the blank holder 141 and the die 145, the plate workpiece W11 is draw-formed into a cross-sectionally trapezoidal shape by the top surface 142*d* of the punch 142. Then, as shown in FIG. 20B, when the punch 142 is fully moved upwardly, the plate workpiece W11 is further draw-formed into a given shape by an interaction between the punch 142 and the die 145.

Figure 21:
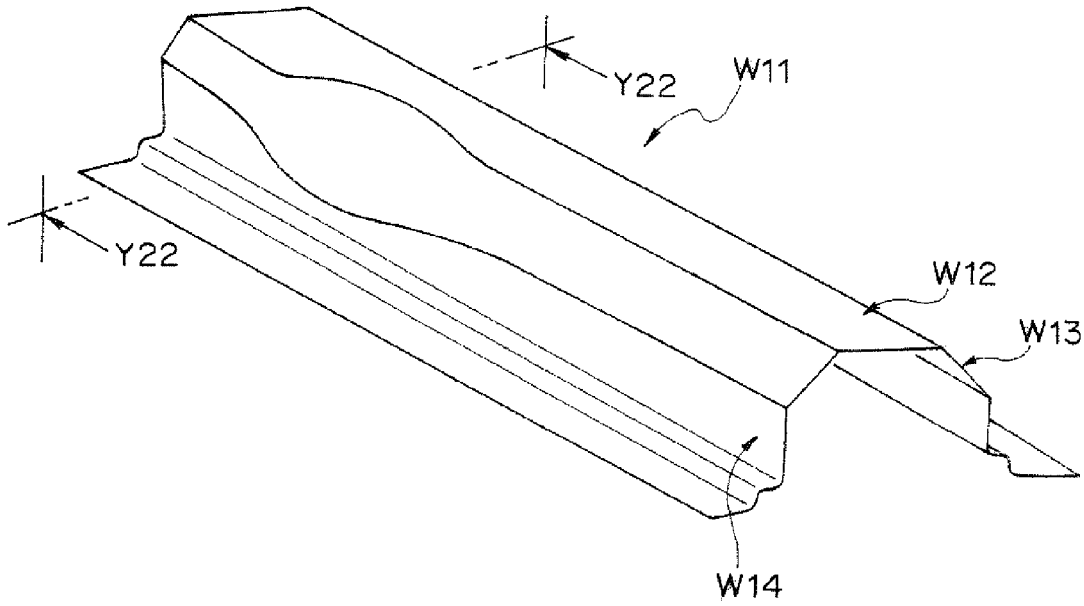
FIG. 21 is a perspective view showing a draw-formed plate workpiece.
Figure 22:
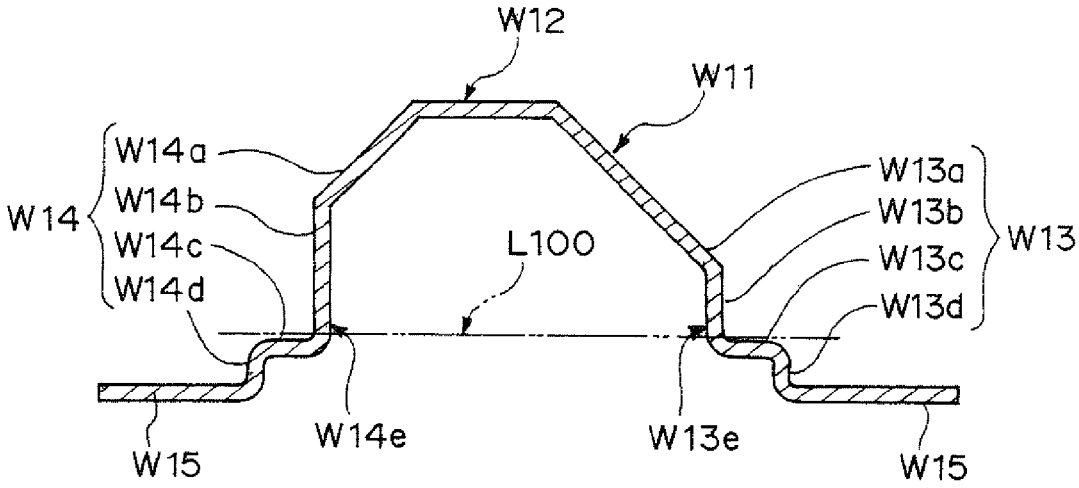
FIG. 22 is a sectional view of the draw-formed plate workpiece, taken along the line Y22-Y22 in FIG. 21.

FIG. 21 is a perspective view showing the draw-formed plate workpiece, and FIG. 22 is a sectional view of the draw-formed plate workpiece, taken along the line Y22-Y22 in FIG. 21. As shown in FIGS. 21 and 22, a laterally central portion of the draw-formed plate workpiece W11, i.e., a portion of the draw-formed plate workpiece W11 other than the opposite lateral ends thereof which have been clamped between the blank holder 141 and the die 145, is press-formed and deformed in a shape convexly protruding in a direction of the movement of the punch 142 relative to the die 145, to have a top wall W12 of a convex-shaped portion (hereinafter arbitrarily referred to as a protruded top wall W12) of the press-formed plate workpiece, and two sidewalls W13, W14 of the convex-shaped portion (hereinafter arbitrarily referred to as protruded sidewalls W13, W14) of the press-formed plate workpiece on respective ones of both sides of the top wall W12, by an interaction between the bottom surface 145*d* of the concave portion 145*b* of the die 145 and the top surface 142*d* of the punch 142.

As shown in FIG. 22, the protruded sidewall W13 is formed on a right side of the protruded top wall W12 by an interaction between each of the first inclined surface 145*e*, the first right vertical surface 145*f*, the right horizontal surface 145*g* and the second right vertical surface 145*h* in the concave portion 145*b* of the die 145, and a corresponding one of the first inclined surface 142*e*, the right vertical surface 142*f*, the right horizontal surface 142*g* and the outer peripheral surface 142*a* in the punch 142. Specifically, the protruded sidewall W13 has a first right sidewall portion W13*a* formed by the interaction between the first inclined surface 145*e* of the concave portion 145*b* and the first inclined surface 142*e* of the punch 142, to inclinedly extend from the protruded top wall W12 obliquely downwardly and rightwardly, a second right sidewall portion W13*b* formed by the interaction between the first right vertical surface 145*f* of the concave portion 145*b* and the right vertical surface 142*f* of the punch 142, to extend from the first right sidewall portion W13*a* vertically downwardly, a third right sidewall portion W13*c* formed by the interaction between the right horizontal surface 145*g* of the concave portion 145*b* and the right horizontal surface 142*g* of the punch 142, to extend from the second right sidewall portion W13*b* horizontally and rightwardly, and a fourth right sidewall portion W13*d* formed by the interaction between the second right vertical surface 145*h* of the concave portion 145*b* and the outer peripheral surface 142*a* of the punch 142, to extend from the third right sidewall portion W13*c* vertically downwardly.

The protruded sidewall W14 is formed on a left side of the protruded top wall W12 by an interaction between each of the second inclined surface 145*i*, the first left vertical surface 145*j*, the left horizontal surface 145*k* and the second left vertical surface 145*l* in the concave portion 145*b* of the die 145, and a corresponding one of the second inclined surface 142*i*, the left vertical surface 142*j*, the left horizontal surface 142*k* and the outer peripheral surface 142*a* in the punch 142. Specifically, the protruded sidewall W14 has a first left sidewall portion W14*a* formed by the interaction between the second inclined surface 145*i* of the concave portion 145*b* and the second inclined surface 142*i* of the punch 142, to inclinedly extend from the protruded top wall W12 obliquely downwardly and leftwardly, a second left sidewall portion W14*b* formed by the interaction between the first left vertical surface 145*j* of the concave portion 145*b* and the left vertical surface 142*j* of the punch 142, to extend from the first left sidewall portion W14*a* vertically downwardly, a third left sidewall portion W14*c* formed by the interaction between the left horizontal surface 145*k* of the concave portion 145*b* and the left horizontal surface 142*k* of the punch 142, to extend from the second left sidewall portion W14*b* horizontally and rightwardly, and a fourth left protruded sidewall portion W14*d* formed by the interaction between the second left vertical surface 145*l* of the concave portion 145*b* and the outer peripheral surface 142*a* of the punch 142, to extend from the third left sidewall portion W14*c* vertically downwardly.

The protruded top wall W12 is formed in conformity of a shape of the bottom wall 122, the third inclined sidewall 127 and the fourth inclined sidewall 128 of the front side frame 120. Further, the first right sidewall portion W13*a* of the protruded sidewall W13 is formed in conformity of a shape of the left sidewall 124 of the front side frame 120, and the second right sidewall portion W13*b* of the protruded sidewall W13 is formed in conformity of a shape of the second inclined sidewall 126 and the top wall 121 of the front side frame 120. The first left sidewall portion W14*a* of the protruded sidewall W14 is formed in conformity of a shape of the right sidewall 123 of the front side frame 120, and the second left sidewall portion W14*b* of the protruded sidewall W14 is formed in conformity of a shape of the first inclined sidewall 125 and the top wall 121 of the front side frame 120.

When the plate workpiece W11 is draw-formed into the above shape by the draw-forming process, under a condition that the opposite lateral ends of the plate workpiece W11 are clamped between the blank holder 141 and the die 145, the punch 142 of the draw-forming die assembly 140 is moved into the forming space 145*c* of the die 145 of the draw-forming die assembly 145 to draw-form the plate workpiece W11 into the above shape. This prevents the occurrence of crimples in the draw-formed plate workpiece W11

After the draw-forming of the plate workpiece W11 using the draw-forming apparatus equipped with the draw-forming die assembly 140, a portion of the draw-formed plate workpiece W11 located below a blanking line L100 illustrated in FIG. 22 is blanked by blanking means (not shown), to cut away the lateral ends W15 of the draw-formed plate workpiece W11 which have been clamped between the blank holder 141 and the die 145, the third right sidewall portion W13*c*, the fourth right sidewall portion W13*d*, the third left sidewall portion W14*c*, and the fourth left sidewall portion W14*d*.

Figure 23:
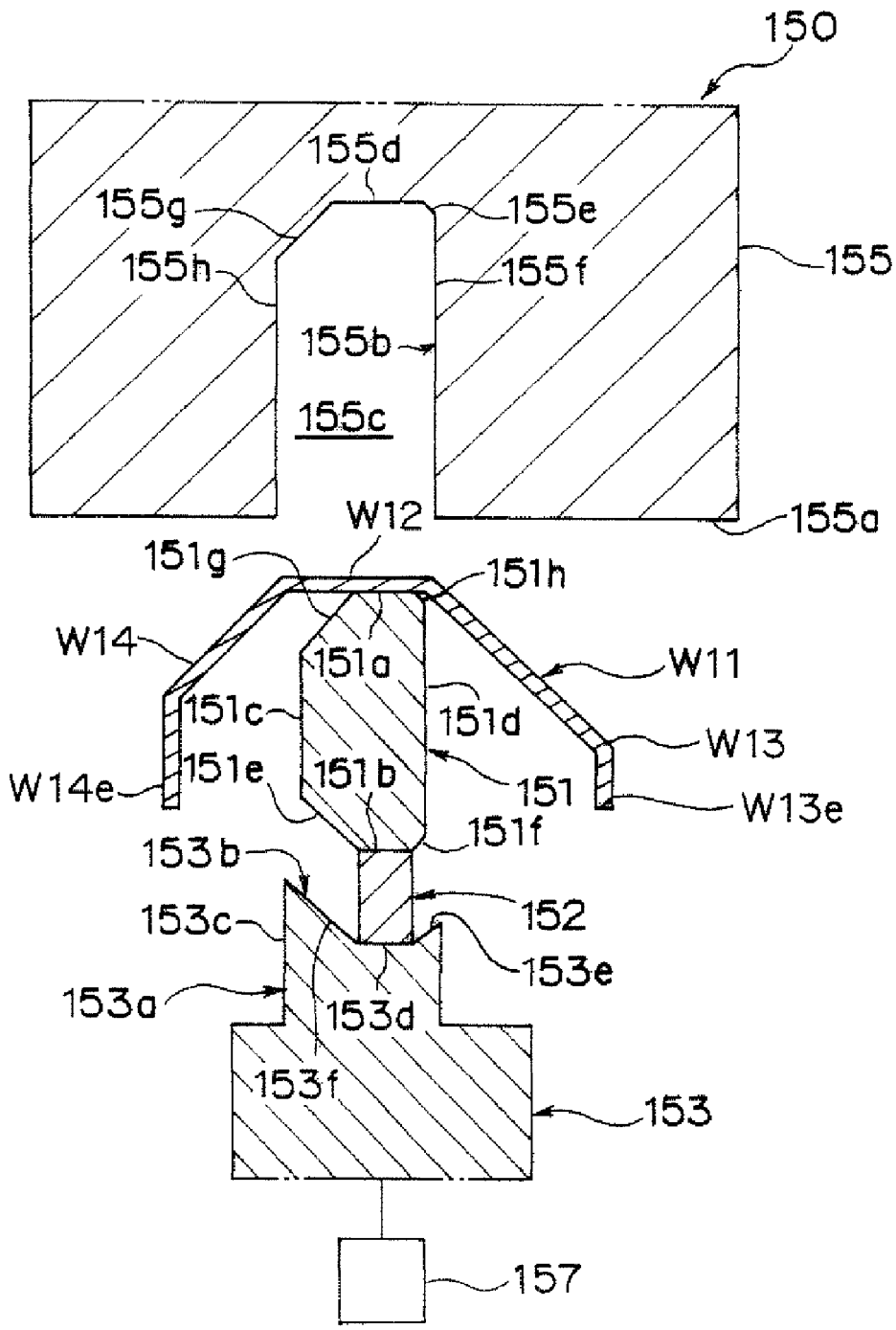
FIG. 23 is a sectional view showing an intrusion-forming die assembly of an intrusion-forming apparatus for intrusion-forming the draw-formed plate workpiece into given shape.
Figure 24:
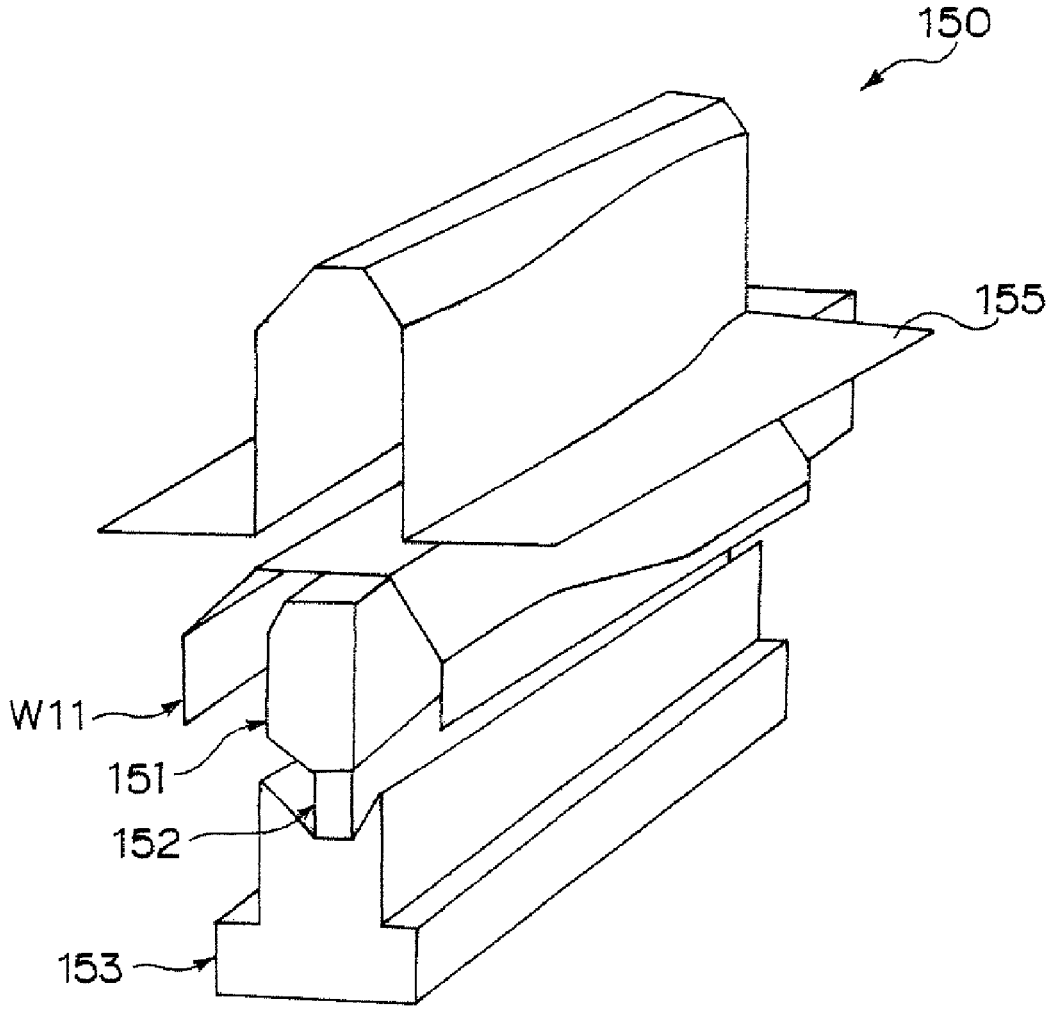
FIG. 24 is a perspective view showing the intrusion-forming die assembly.

Subsequently, the draw-formed plate workpiece W11 is subjected to an intrusion-forming process for intrusion-forming the draw-formed plate workpiece W11 into a given shape within a concave portion of a receiving die, to allow the protruded top wall W12 of the draw-formed plate workpiece W11 to be pressed in the convexly protruding direction of the draw-formed plate workpiece W11 and intrusion-formed into a given shape in conformity to the front side frame 120. FIG. 23 is a sectional view showing an intrusion-forming die assembly of an intrusion-forming apparatus, and FIG. 24 is a perspective view showing the intrusion-forming die assembly. In FIG. 23, an after-mentioned punch transfer mechanism is also illustrated, and in FIGS. 23 and 24, the plate workpiece is also illustrated.

As shown in FIGS. 23 and 24, the intrusion-forming die assembly (second forming die assembly) 150 of the intrusion-forming apparatus for forming the plate workpiece W11 into a given shape comprises a core die 151, a liner member 152 disposed to detachably support the core die 151, a punch 153 disposed to detachably support the liner member 152 and adapted to be movable in an upward-rearward direction, and a receiving die 155 disposed in opposed relation to the core die 151 and adapted to allow the plate workpiece W11 to be pressed thereinto by the core die 151.

As shown in FIG. 23, the core die 151 of the intrusion-forming die assembly 150 is formed in conformity of a desired shape of the front side frame 120. Specifically, the core die 151 has a top surface 151*a*, a bottom surface 151*b*, a left side surface 151*c*, a right side surface 151*d*, a first inclined side surface 151*e*, a second inclined side surface 151*f*, a third inclined side surface 151*g* and a fourth inclined side surface 151*h* each formed in conformity to a respective one of the bottom wall 122, the top wall 121, the right sidewall 123, the left sidewall 124, the first inclined sidewall 125, the second inclined sidewall 126, the third inclined sidewall 127 and the fourth inclined sidewall 128 of the front side frame 120. The protruded top wall W12 of the draw-formed plate workpiece W11 is held on the top surface 151*a* of the core die 151.

The liner member 152 provided in the intrusion-forming die assembly to support the core die 151 is disposed beneath the core die 151, and formed in a cross-sectionally rectangular shape to have a cross-sectional length approximately equal to that of the bottom surface 151*b* of the core die 151. The liner member 152 comprises a core-die connection pin (not shown) for connection to the core die 151. Specifically, the liner member 152 is adapted to detachably support the core die 151 in such a manner that it is connected to the core die 151 by inserting the core-die connection pin into a connection hole (not shown) formed in the core die 151. The liner member 152 also has a punch connection pin (not shown) for connection to the punch 153.

The punch 153 supporting the liner member 152 has a raised portion 153*a* formed in a head hereof. The raised portion 153*a* has an upper surface 153*b* and an outer peripheral surface 153*c*. The upper surface 153*b* includes a horizontal surface region 153*d* formed in conformity to a shape of the top wall 121 of the front side frame 120 to extend in a horizontal direction, a first inclined surface region 153*e* formed in conformity to a shape of the second inclined sidewall 126 of the front side frame 120 to inclinedly extend from the horizontal surface region 153*d* obliquely upwardly and rightwardly, and a second inclined surface region 153*f* formed in conformity to a shape of the first inclined sidewall 125 of the front side frame 120 to inclinedly extend from the horizontal surface region 153*d* obliquely upwardly and rightwardly.

The punch 153 is adapted to detachably support the liner member 152 in such a manner that it is connected to the liner member 152 by inserting the punch connection pin into a connection hole (not shown) formed in the horizontal surface region 153*d*. In the intrusion-forming die assembly, the core die 151 supported by the liner member 152 and the liner member 152 supported by the punch 153 are adapted to be moved in the upward-downward direction according to an upward-downward movement of the punch 153 driven by punch drive mechanism 157 as driving means operable to move the punch 152 in the upward-downward direction.

The receiving die 155 of the intrusion-forming die assembly 150 has a concave portion 155*b* formed in a lower surface 155*a* thereof to allow the draw-formed plate workpiece W11 to be pressed thereinto, so that a forming space 155*c* is defined inside the concave portion 155*b* to form the draw-formed plate workpiece W11 into a given shape. As shown in FIG. 23, the concave portion 155*b* formed in the receiving die 155 of the intrusion-forming die assembly 150 is formed in conformity to the desired shape of the front side frame 120. Specifically, the concave portion 155*b* has a bottom surface 155*b* formed in conformity to a shape of the bottom wall 122 of the front side frame 120 to extend horizontally, a first inclined side surface 155*e* formed in conformity to a shape of the fourth inclined sidewall 128 of the front side frame 120 to inclinedly extend from the bottom surface 155*d* obliquely downwardly and rightwardly, a right vertical surface 155*f* formed in conformity to a shape of the left sidewall 124 of the front side frame 120 to extend from the first inclined surface 155*e* vertically downwardly, a second inclined side surface 155*g* formed in conformity to a shape of the third inclined sidewall 127 of the front side frame 120 to inclinedly extend from the bottom surface 155*d* obliquely downwardly and leftwardly, and a left vertical surface 155*h* formed in conformity to a shape of the right sidewall 123 of the front side frame 120 to extend from the second inclined surface 155*g* vertically downwardly.

The intrusion-forming apparatus equipped with the above intrusion-forming die assembly 150 is operable, under a condition that the protruded top wall W12 of the draw-formed plate workpiece W11 is held on the core die 151, to move the core die 151 upwardly to allow the draw-formed plate workpiece W11 to be pressed into the concave portion 155*b* of the receiving die 155 by the core die 151 and formed into a shape where respective ends W13*e*, W14*e* of the protruded sidewalls W13, W14 of the draw-formed plate workpiece W11 to extend in a direction opposite to a pressing direction of the core die 151 and toward an inward side of the concave portion 155*b*.

In the intrusion-forming for the draw-formed plate workpiece W11 using the intrusion-forming die assembly 150, the protruded top wall W12 is held on the top surface 151*a* of the core die 151 in a posture where the protruded top wall W12 is located at the uppermost position, as shown in FIG. 23. Then, the punch 153 of the intrusion-forming die assembly 150 is moved upwardly, and the core die 151 is moved upwardly according to the upward movement of the punch 153, so that the draw-formed plate workpiece W11 is intrusion-formed into a given shape by an interaction between the core die 151 and the receiving die 155.

Figure 25A:
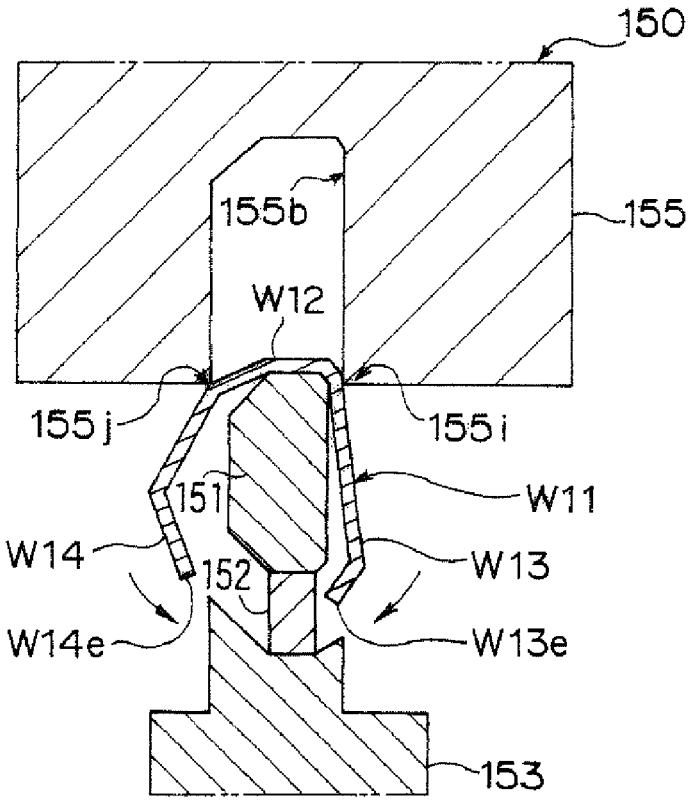
FIGS. 25A and 25B are explanatory diagrams showing an intrusion-forming process.
Figure 25B:
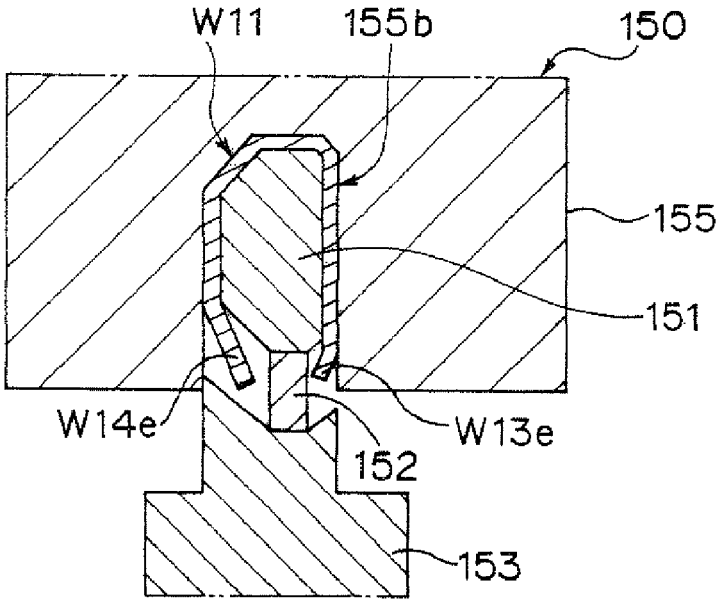

FIGS. 25A and 25B are explanatory diagram showing an intrusion-forming process, wherein FIG. 25A shows a state just after the draw-formed plate workpiece W11 is pressed into the concave portion of the receiving die of the intrusion-forming die assembly, and FIG. 25B shows a state after the draw-formed plate workpiece W11 is fully pressed into the concave portion of the receiving die of the intrusion-forming die assembly.

When the core die 151 is moved upwardly under a condition that the draw-formed plate workpiece W11 is held on the core die 151, a right portion of the protruded top wall W12 of the draw-formed plate workpiece W11 is bent and formed into a give shape by an interaction between the core die 151, and the receiving die 155, specifically, a shoulder 155*i* of the receiving die 155 which is an intersection between the right vertical surface 155*f* and the lower surface 155*a* of the receiving die 155, so that the protruded sidewall W13 is displaced inwardly, i.e., a direction allowing the draw-formed plate workpiece W11 to have a cross-sectionally closed shape, as shown in FIG. 25A. In the same manner, a left portion of the protruded top wall W12 of the draw-formed plate workpiece W11 is bent and formed into a give shape by an interaction between the core die 151, and the receiving die 155, specifically, a shoulder 155*j* of the receiving die 155 which is an intersection between the left vertical surface 155*h* and the lower surface 155*a* of the receiving die 155, so that the protruded sidewall W14 is displaced inwardly, i.e., a direction allowing the draw-formed plate workpiece W11 to have a cross-sectionally closed shape, as shown in FIG. 25A.

When the core die 151 is further moved upwardly, and the draw-formed plate workpiece W11 is fully pressed into the concave portion 155*b* of the receiving die 155 by the core die 115, the draw-formed plate workpiece W11 is bent by an interaction between the core die 151 and the receiving die 155, so that the protruded sidewalls W13, W14 on respective ones of both sides of the protruded top wall W11 are further displaced inwardly, i.e., the respective directions allowing the draw-formed plate workpiece W11 to have a cross-sectionally closed shape, as shown in FIG. 25B. Further, according to the displacement, each of the ends W13*e*, W14*e* of the protruded sidewalls W13, W14 is formed to have a shape extending in a direction opposite to the pressing direction of the core die 151 and toward the inward side of the concave portion 155*b*, as shown in FIG. 25B. The liner member 152 is formed to prevent interference with the ends W13*e*, W14*e* of the protruded sidewalls W13, W14 of the draw-formed plate workpiece W11 when the draw-formed plate workpiece W11 is pressed into the concave portion 155*b* of the receiving die 155 by the core die 151.

When the draw-formed plate workpiece W11 is pressed into the concave portion 155*b* of the receiving die 155 by the core die 151, the bottom wall 122 of the front side frame 120 is formed by an interaction between the bottom surface 155*d* of the concave portion 155*b* of the receiving die 155 and the top surface 151*a* of the core die 151, and the fourth inclined sidewall 128 of the front side frame 120 is formed by an interaction between the first inclined surface 155*e* of the concave portion 155*b* of the receiving die 155 and the fourth inclined side surface 151*h* of the core die 151. Further, the left sidewall 124 of the front side frame 120 is formed by an interaction between the right vertical surface 155*f* of the concave portion 155*b* of the receiving die 155 and the right side surface 151*d* of the core die 151, and the third inclined sidewall 127 of the front side frame 120 is formed by an interaction between the second inclined surface 155*g* of the concave portion 155*b* of the receiving die 155 and the third inclined side surface 151*g* of the core die 151. The right sidewall 123 of the front side frame 120 is formed by an interaction between the left vertical surface 155*h* of the concave portion 155*b* of the receiving die 155 and the left side surface 151*c* of the core die 151.

In the draw-forming process, the plate workpiece W11 is bend-formed into a shape which allows the each of the ends W13*e*, W14*e* of the bend-formed plate workpiece W11 to extend in a direction opposite to the pressing direction of the core die 151 of the intrusion-forming die assembly 150 and toward the inward side of the concave portion 155*b* of the receiving die 155 of the intrusion-forming die assembly 150, when the draw-formed plate workpiece W11 is pressed into the concave portion 155*b*.

After the draw-formed plate workpiece W11 is pressed into the concave portion 155*b* of the receiving die 155 of the intrusion-forming die assembly 150 and intrusion-formed into a given shape, by the core die 151 of the intrusion-forming die assembly 150, under a condition that the core die 151 is held within the intrusion-formed plate workpiece W11, a final bend-forming process is performed to bring the ends W13*e*, W14*e* of the intrusion-formed plate workpiece W11 into contact with each other by an interaction of the punch 153 and the core die 151, so that the intrusion-formed plate workpiece W11 is formed into a cross-sectionally closed shape.

Figure 26A:
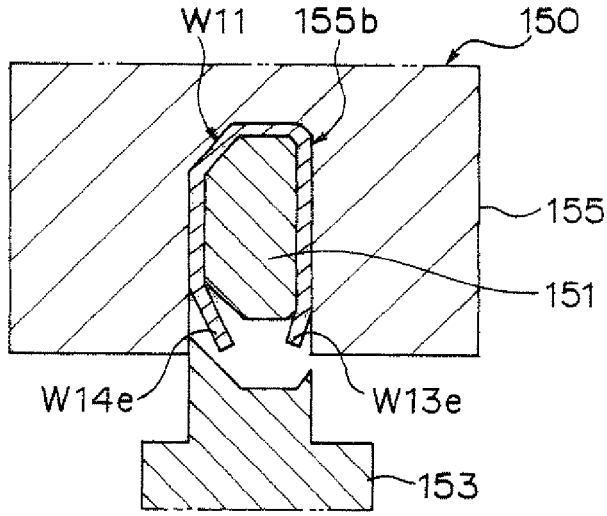
FIGS. 26A to 26C are explanatory diagrams showing a final bend-forming process.
Figure 26B:
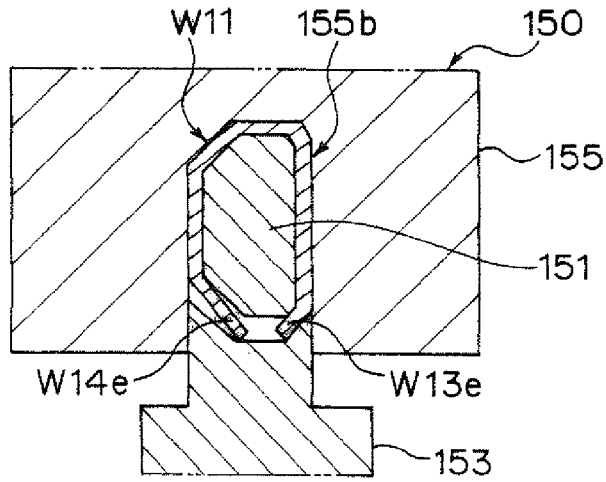
Figure 26C:
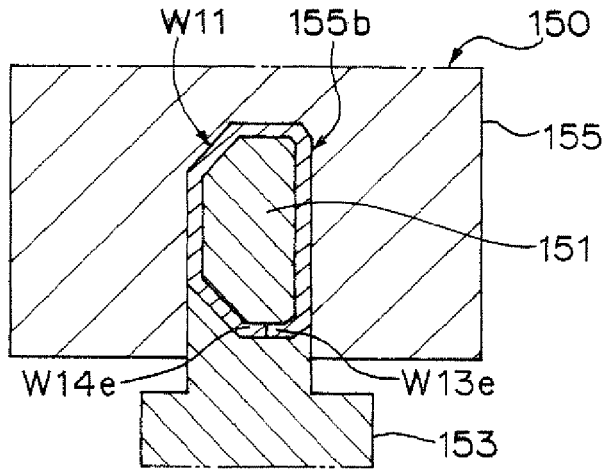

FIGS. 26A to 26C are explanatory diagrams showing the final bend-forming process, wherein FIG. 26A, FIG. 26B and FIG. 26C show a state after the intrusion-forming process is completed and the liner member is detached, a state when the intrusion-formed plate workpiece is being pressed and bend by the punch, and a state after the intrusion-formed plate workpiece is fully pressed and bend-formed into a final shape by the punch, respectively.

After the draw-formed plate workpiece W11 is pressed into the concave portion 155*b* of the receiving die 155 of the intrusion-forming die assembly 150 and s intrusion-formed into a given shape, by the core die 151 of the intrusion-forming die assembly 150, under the condition that the core die 151 is held within the intrusion-formed plate workpiece W11, the punch 153 is moved downwardly, and the liner member 152 interposed between the core die 151 and the punch 153 is detached, as shown in FIG. 26A.

After the liner member 152 is detached, the punch 153 is moved upwardly again, and the ends W13*e*, W14*e* each extending in the direction opposite to the pressing direction of the core die 151 of the intrusion-forming die assembly 150 and toward the inward side of the concave portion 155*b* are pressed by the upper surface 153*b* of the punch 155, so that each of the ends W13*e*, W14*e* of the intrusion-formed plate workpiece W11 is further bent inwardly, i.e., in a direction allowing the intrusion-formed plate workpiece W11 to have a cross-sectional closed shape, as shown in FIG. 26B.

Then, when the punch 153 is further moved upwardly, each of the ends W13*e*, W14*e* of the intrusion-formed plate workpiece W11 is further bent inwardly, i.e., in the direction allowing the intrusion-formed plate workpiece W11 to have a cross-sectional closed shape, by the upper surface 153*b* of the punch 155, so that the ends W13*e*, W14*e* of the intrusion-formed plate workpiece W11 are brought into contact with each other and butted together, and the intrusion-formed plate workpiece W11 is formed into a cross-sectionally closed shape, as shown in FIG. 26C. The core die 151 is adapted to be pulled out from a closed-section member, i.e., the final-bend-formed plate workpiece W11 formed into the cross-sectionally closed shape, in a longitudinal direction thereof.

When the ends W13*e*, W14*e* of the intrusion-formed plate workpiece W11 is pressed and bend by the upper surface 153*b* of the punch 155, the top surface 122 of the front side frame 120 by an interaction between the horizontal surface region 153*d* of the punch 153 and the bottom surface 151*b* of the core die 151, and the second inclined sidewall 126 of the front side frame 120 by an interaction between the first inclined surface region 153*e* of the punch 153 and the second inclined side surface 151*f* of the core die 151. Further, the first inclined sidewall 125 of the front side frame 120 by an interaction between the second inclined surface region 153*f* of the punch 153 and the first inclined side surface 151*e* of the core die 151.

After the ends W13*e*, W14*e* of the intrusion-formed plate workpiece W11 are brought into contact with each other and butted together, and the intrusion-formed plate workpiece W11 is formed into the cross-sectionally closed shape, the ends W13*e*, W14*e* of the final-bend-formed plate workpiece W11 brought into contact with each other and butted together are joined together by welding, such as laser welding, so that the front side frame 120 as a close-section member formed in a cross-sectionally closed shape can be produced without providing a flange portion thereto. As above, the method according to the second embodiment includes the welding process of mutually welding the ends W13*e*, W14*e* of the final-bend-formed plate workpiece W11 brought into contact with each other and butted together. This makes it possible to increase joint strength of a metal closed-section member to produce a stronger metal closed-section member.

In the second embodiment, the final bend-forming process, under the condition that the core die 151 is held within the plate workpiece W11 intrusion-formed in the intrusion-forming sub-step, the ends W13*e*, W14*e* of the intrusion-formed plate workpiece W11 are pressed and bent by the punch 153 of the intrusion-forming die assembly 150, in such a manner as to be brought into contact with each other and butted together to allow the intrusion-formed plate workpiece W11 to have the cross-sectionally closed shape. Alternatively, the ends W13*e*, W14*e* of the intrusion-formed plate workpiece W11 may be brought into contact with each other and superimposed on each other to allow the intrusion-formed plate workpiece W11 to have the cross-sectionally closed shape. In this case, in the welding process, the superimposed ends W13*e*, W14*e* of the final-bend-formed plate workpiece W1 in contact with each other are preferably joined together by lap welding or fillet welding.

In the second embodiment, when the draw-formed plate workpiece W11 is pressed into the concave portion 155*b* of the receiving die 155 of the intrusion-forming die assembly 150, each of the lateral ends W13*e*, W14*e* of the draw-formed plate workpiece W11 is intrusion-formed to extend in the direction opposite to the pressing direction of the core die 151 and toward the inward side of the concave portion 155*b*. Alternatively, during the intrusion-forming process, only one of the lateral ends of the draw-formed plate workpiece W11 may be intrusion-formed to extend in the direction opposite to the pressing direction of the core die of the intrusion-forming die assembly and toward the inward side of the concave portion, during the intrusion-forming process. In this case, in the final bend-forming process, only the one end of the intrusion-formed plate workpiece is pressed in such a manner that the ends of the intrusion-formed plate workpiece are brought into contact with each other, and the intrusion-formed plate workpiece is formed into a cross-sectionally closed shape.

Further, in the second embodiment, as a preliminary bend-forming process, in the draw-forming process, the plate workpiece W11 is bend-formed into a shape which allows each the ends W13*e*, W14*e* of the bend-formed plate workpiece W11 to extend in the direction opposite to the pressing direction of the core die 151 and toward the inward side of the concave portion 155*b* of the receiving die 155 of the intrusion-forming die assembly 150, when the bend-formed plate workpiece W11 is pressed into the concave portion 155*b*. Alternatively, another type of press-forming process, such as stretch forming, may be used, and, under a condition that a metal plate workpiece W11 is clamped between a blank holder and a die of a press-forming die assembly, a punch of a press-forming die assembly may be moved into a forming space of the die to press-form the plate workpiece W11. In this case, the plate workpiece is bend-formed into a shape which allows at least one of opposite ends of the bend-formed plate workpiece to extend in the direction opposite to the pressing direction of the core die and toward the inward side of the concave portion of the receiving die of the intrusion-forming die assembly, when the bend-formed plate workpiece is pressed into the concave portion, in the same manner as that in the second embodiment.

As above, the production method for the front side frame 120 as a metal closed-section member, according to the second embodiment, comprises a first press-forming step of, under a condition that a metal plate workpiece W11 is clamped between a die 145 and a blank holder 141 of a first forming die assembly 140, moving a punch 142 of the first forming die assembly 140 into a forming space 145*c* of the die 145, so that the plate workpiece W11 is press-formed into a shape convexly protruding in a direction of the movement of the punch 142 relative to the die 145, and a second press-forming step of, after the first press-forming step, under a condition that the press-formed plate workpiece W11 is positioned between a receiving die 155 and a core die 151 of a second forming die assembly 150, wherein the core die 151 is disposed on the side opposite to the convexly protruding direction of the press-formed plate workpiece W11, moving the core die 151 relative to the receiving die 155 to allow a top wall W12 of a convex-shaped portion of the press-formed plate workpiece W11 to be pressed in the convexly protruding direction of the press-formed plate workpiece W11 and formed into a given shape, so that two sidewalls W13, W14 of a convex-shaped portion of the press-formed plate workpiece W11 formed on respective ones of both sides of the top wall W12 during the first press-forming step are displaced toward an inward side of the press-formed plate workpiece W11 and cross-sectionally closed together. This makes it possible to accurately produce a metal closed-section member in a relatively simple manner while preventing the occurrence of crimples in the plate workpiece.

In the second embodiment, the first press-forming step is a preliminary bend-forming step of preliminarily bend-forming the plate workpiece W11 into a given shape, and the second press-forming step includes an intrusion-forming sub-step of pressing the bend-formed plate workpiece W11 into the concave portion 155*b* of the receiving die 155 of the second forming die assembly 150 by the core die 151 of the second forming die assembly 150, to intrusion-form the bend-formed plate workpiece W11 into a shape where at least one of opposite ends W13*e*, W14*e* thereof extends in a direction opposite to a pressing direction of the core die 151 and toward an inward side of the concave portion 155*b*, and a final bend-forming sub-step of, under a condition that the core die 151 is held within the intrusion-formed plate workpiece W11, pressing and bending the ends W13*e*, 14*e* of the intrusion-formed plate workpiece W11 by a punch 153 of the second forming die assembly 150 to bring the ends W13*e*, W13*e* of the intrusion-formed plate workpiece W11 into contact with each other by the punch 153 and the core die 151, so that the intrusion-formed plate workpiece is formed into the cross-sectionally closed shape, wherein the preliminary bend-forming step includes bend-forming the plate workpiece W11 into a shape which allows the at least one end (W13*e*, W14*e*) of the bend-formed plate workpiece W11 to extend in the direction opposite to the pressing direction of the core die 151 and toward the inward side of the concave portion 155*b* of the receiving die 155 of the intrusion-forming die assembly 150, when the bend-formed plate workpiece W11 is pressed into the concave portion 155*b*. Thus, even if the plate workpiece W11 is produced as a closed-section member having a cross-sectional shape changing in a longitudinal direction thereof, a metal closed-section member can be accurately produced from the plate workpiece by intrusion-forming the bend-formed plate workpiece W11 using the core die 151 and the receiving die 155 of the intrusion-forming die assembly 150, and bend-forming the ends W13*e*, W14*e* of the intrusion-formed plate workpiece W11 using the punch 150 and the core die 151 of the intrusion-forming die assembly 150.

The intrusion-forming sub-step includes moving the core die 151 of the intrusion-forming die assembly 150 into the concave portion 155*b* of the receiving die 155 of the intrusion-forming die assembly 150 by driving means which is additionally used to move the punch 153 of the intrusion-forming die assembly 150 during the final bend-forming sub-step. This makes it possible to carry out the intrusion-forming in a relatively simple manner without a need for transferring the intrusion-formed plate workpiece between the intrusion-forming sub-step and the final bend-forming sub-step.

The intrusion-forming sub-step includes moving the core die 151 into the concave portion 155*b* while interposing a liner member 152 between the core die 151 and the punch 153, and the final bend-forming sub-step includes, under a condition that the liner member 152 is detached from between the core die 151 and the punch 153, and the core die 151 is held within the intrusion-formed plate workpiece W11, bending the ends W13*e*, W14*e* of the intrusion-formed plate workpiece W11 by the punch 153 of the intrusion-forming die assembly 150. This makes it possible to obtain the above advantages while preventing interference between the bend-formed plate workpiece and the punch during the intrusion-forming sub-step based on the liner member.

In the second embodiment, under the condition that the draw-formed plate workpiece W11 is positioned between the receiving die 155 and the core die 151 of the second forming die assembly 150, wherein the core die 151 is disposed on the side opposite to the convexly protruding direction of the draw-formed plate workpiece W11, the core die 151 is moved relative to the receiving die 155 to allow the top wall W12 of the draw-formed plate workpiece W11 to be pressed in the convexly protruding direction of the draw-formed plate workpiece W11 and formed into a given shape, so that the sidewalls W13, W14 of the draw-formed plate workpiece W11 formed on the respective ones of both sides of the top wall W12 during the first press-forming step are displaced toward the inward side of the draw-formed plate workpiece W11 and cross-sectionally closed together. Alternatively, the receiving die 155 may be moved relative to the core die 151 to allow the sidewalls W13, W14 of the draw-formed plate workpiece W11 formed on the respective ones of both sides of the top wall W12 during the first press-forming step to be displaced toward the inward side of the draw-formed plate workpiece W11 and cross-sectionally closed together.

As is clear from the above description, in the above embodiments, under a condition that a metal plate workpiece is clamped between a die and a blank holder of a first forming die assembly, a punch of the first forming die assembly is moved into a forming space of the die, so that the plate workpiece is press-formed into a convex shape, and, under a condition that the press-formed plate workpiece is positioned between a receiving die and a core die of a second forming die assembly, causing relative movement of the core die with respect to the receiving die to allow a top wall of a convex-shaped portion of the press-formed plate workpiece to be press-formed into a given shape, so that two sidewalls of a convex-shaped portion of the press-formed plate workpiece on respective ones of both sides of the top wall are displaced toward an inward side of the press-formed plate workpiece and cross-sectionally closed together. This makes it possible to accurately produce a metal closed-section member in a relatively simple manner while preventing the occurrence of crimples in the plate workpiece.

In the above embodiments, under the condition that the metal plate workpiece is clamped between the die and the blank holder of the first forming die assembly, the punch of the first forming die assembly is moved into the forming space of the die to press-form the plate workpiece. Alternatively, the die and the blank holder clamping the plate workpiece therebetween may be moved relative to the punch to press-form the plate workpiece.

The present invention is directed to a method of producing a metal closed-section member from a metal plate workpiece, and can be effectively applied to the production of a member to be formed in a cross-sectionally closed shape, for example, a vehicle body member, such as a front side frame or a rear side frame.

Advantageous embodiments of the present invention have been shown and described. It is to be understood that the present invention is not limited to such specific embodiments, but various changes and modifications in design may be made therein without departing from the spirit and scope of the present invention.

What is claimed is:

1. A method of producing a metal closed-section member formed in a cross-sectionally closed shape, from a metal plate workpiece, comprising:

a first press-forming step of providing a first forming die assembly, and, under a condition that the plate workpiece is clamped between a die and a blank holder of the first forming die assembly, causing relative movement of a punch of the first forming die assembly with respect to the die to allow the punch to be moved into a forming space of the die, so that the plate workpiece is press-formed into a shape convexly protruding in a direction of the movement of the punch relative to the die, and a convex wall portion is formed in the top wall of the press-formed plate workpiece to protrude in a direction opposite to the convexly protruding direction of the press-formed plate workpiece; and a second press-forming step of providing a second forming die assembly, and, after the first press-forming step, under a condition that the press-formed plate workpiece is positioned between a receiving die and a core die of the second forming die assembly, wherein the core die is disposed on the side opposite to the convexly protruding direction of the press-formed plate workpiece, and that the press-formed plate workpiece is held on the receiving die of the second forming die assembly while allowing the convex wall portion of the press-formed plate workpiece to be placed on a concave portion of the receiving die, causing relative movement of the core die with respect to the receiving die to allow the convex wall portion of the press-formed plate workpiece to be flattened and formed as a press-formed wall, by an interaction between the core die of the second forming die assembly and the concave portion, so that two sidewalls of a convex-shaped portion of the press-formed plate workpiece formed on respective ones of both sides of the top wall during the first press-forming step are displaced toward an inward side of the press-formed plate workpiece and cross-sectionally closed together, and wherein a cross-sectional length of at least one of the sidewalls changes in a longitudinal direction of the closed-section member, and wherein the first press-forming step includes forming the convex wall portion to divide the top wall into two top wall portions along a longitudinal direction of the press-formed plate workpiece, in such a manner that a cross-sectional length of at least one of the top wall portions of the top wall divided by the convex wall portion changes in the longitudinal direction; and the receiving die of the second forming die assembly for use in the second press-forming step is configured such that a cross-sectional length of a side surface of the concave portion of the receiving die is approximately equal to a shortest one of a plurality of cross-sectional lengths of the at least one top wall portion of the top wall.

2. The method as defined in claim 1, which further comprises an end-bending step of, between the first press-forming step and the second press-forming step, bending at least one of respective ends of the sidewalls of the press-formed plate workpiece on the side opposite to the top wall, toward the inward side of the press-formed plate workpiece.

3. The method as defined in claim 1, wherein the convex wall portion of the top wall of the press-formed plate workpiece is formed in a cross-sectionally arc or trapezoidal shape.

4. The method as defined in claim 1, which further comprises a final press-forming step of, after the second press-forming step, pressing respective ends of the cross-sectionally-closed sidewalls of the press-formed plate workpiece against a surface of the core die on an opposite side of a surface thereof used to press the top wall.

5. The method as defined in claim 1, which further comprises a welding step of, after the second press-forming step, mutually welding the respective ends of the cross-sectionally-closed sidewalls of the press-formed plate workpiece.

6. The method as defined in claim 1, wherein the core die of the second forming die assembly for use in the second press-forming step has a cross-sectional width less than that of the closed-section member.

* * * * *